US006341571B1

(12) United States Patent
Russell et al.

(10) Patent No.: US 6,341,571 B1
(45) Date of Patent: Jan. 29, 2002

(54) WIND-POWERED AIR/WATER INTERFACE CRAFT HAVING VARIOUS WING ANGLES AND CONFIGURATIONS

(76) Inventors: Diana Russell, 313 Centre Island Rd., Oyster Bay, NY (US) 11771; Peter K. Wallace, 331 E. 88th St. Apt. 1D, New York, NY (US) 10128

( * ) Notice: Subject to any disclaimer, the term of this patent is extended or adjusted under 35 U.S.C. 154(b) by 0 days.

(21) Appl. No.: 09/479,872

(22) Filed: Jan. 10, 2000

Related U.S. Application Data

(60) Continuation-in-part of application No. 09/357,130, filed on Jul. 20, 1999, now Pat. No. 6,216,621, which is a division of application No. 08/944,836, filed on Oct. 6, 1997, now Pat. No. 6,016,759.

(51) Int. Cl.[7] ..... B63B 35/00
(52) U.S. Cl. ..... 114/39.21; 114/102.1
(58) Field of Search ..... 114/39.21, 39.29, 114/39.31, 39.32, 102.1, 102.12, 102.16, 102.22, 102.29, 108, 109, 111

(56) References Cited

U.S. PATENT DOCUMENTS

| | | | | |
|---|---|---|---|---|
| 2,106,432 A | | 1/1938 | McIntyre | |
| 3,800,724 A | | 4/1974 | Tracy | |
| 3,966,143 A | | 6/1976 | Smith | |
| 3,987,982 A | | 10/1976 | Amick | |
| 4,047,493 A | * | 9/1977 | Menegus | 114/102 |
| 4,582,011 A | | 4/1986 | Logan | |
| 4,592,298 A | | 6/1986 | Finot | |
| 4,635,577 A | | 1/1987 | Palmquist | |
| 4,653,417 A | | 3/1987 | White | |
| 4,682,557 A | | 7/1987 | Magruder et al. | |
| 4,934,296 A | | 6/1990 | Smith et al. | |
| 4,947,775 A | | 8/1990 | Bamford | |
| 5,083,520 A | * | 1/1992 | Bonnet | 114/102 |
| 5,168,824 A | | 12/1992 | Ketterman | |
| 5,197,401 A | | 3/1993 | Finley | |

OTHER PUBLICATIONS

McIntyre, M., The Sailplane, Yachting, Feb. 1934, pp. 67,68.
Vincent, R.E., Beware–Low Flying boats, Yachting World, May 1972, pp. 98,99.
Collins, K., Thrust and Lift, South East Boardsailor, Mar. 1986, pp. 13–17.
Wind Weapon sailors take flight in Connecticut, New England Sailboard Journal, Dec. 1986–Jan. 1987, p. 12.
Mike O'Brien, Designer White draws on Multihull experience, Trade Inside, May 1987, pp. B10, B11 and B14.
Palmquist, M.J., Multihulls on Expermental Craft, Multihulls, Mar./Apr. 1988, pp. 47–49.
Crowell, Robert L., The Aerostar, Ideal Design, Inc.

* cited by examiner

*Primary Examiner*—Ed Swinehart
(74) *Attorney, Agent, or Firm*—Pillsbury Winthrop LLP

(57) ABSTRACT

A wind powered air/water interface craft disposed in a mechanically simple configuration(s) with means for trimming and/or adjusting the area of the various air and water foil elements either independently or together or both. All of its structural elements are useful as lifting or-driving surfaces or buoyant elements thereby minimizing parasitic drag and conflicting forces. In some configurations, free flight is also possible for brief periods of time or for longer periods in conditions where dynamic soaring is possible. The rig is able to develop vertical lift before necessarily having forward motion. Although similar in some configurations to a windsurfer, its operation is not dependent on the strength of the human operator, so that it has the capacity for power and payload greater than the strength and weight of the operator. The triangle rig configuration of the invention may develop vertical lift, but may in some instances use vertical lift only to enhance dynamic stability of a displacement craft. A wide beam single hull ship uses triangle rig sails to augment the ship's engines.

12 Claims, 23 Drawing Sheets

EQUILIBRIUM RM = HM $G = F_V + \Delta a$ $RM = G \times S \times \cos\phi$ $HM = (s - h) \times F_p \cos\delta + (s + h) \times F_s \cos\delta$ $F_{hs} = F_s \sin(\phi + 2\delta)$ $F_{vs} = F_s \cos(\phi + 2\delta)$ $F_{hp} = Fp \sin\phi$ $F_{vp} = Fp \cos\phi$

WIND-POWERED AIR/WATER INTERFACE CRAFT HAVING VARIOUS WING ANGLES AND CONFIGURATIONS

This application is a Continuation-in-Part of application Ser. No. 09/357,130, filed Jul. 20, 1999, now U.S. Pat. No. 6,216,621 which is a divisional application based on parent application Ser. No. 08/944,836, filed Oct. 6, 1997, now U.S. Pat. No. 6,016,759 each of which is hereby incorporated by reference.

BACKGROUND OF THE INVENTION

Watercraft whose means of developing dynamic lift is entirely from hydrofoils and/or planing elements develop a certain amount of drag from the structure that keeps all of these water and air foils positioned and linked. Furthermore, the performance of a hydrofoil deteriorates near the surface of the water. More extensive use of airfoil surfaces with adequate means of control and adjustment is a possible solution. Where these surfaces have a variable cant relative to the horizontal and fore and aft pivot relative to the lateral plane, trimming and controlling them to develop vertical lift or horizontal drive is analogous to trimming a windsurfer sail.

In addition to the Schweitzer/Drake windsurfer, prior art devices with which the craft of the present invention can be usefully compared and contrasted include the Amick flying boat, the Smith self-launching glider, the Magruder sailing wing and the McIntyre sailplane.

SUMMARY OF THE INVENTION

The wind-powered air/watercraft interface craft includes a fuselage or hull with a pivoting wing and tailplane, canard or secondary tandem wing and port and starboard wing tip amas, hulls, pontoons or floats of which each may have leeboards/centerboards for lateral resistance and forward or aft skegs/trim tabs/rudders, and additional sails or driving surfaces such that the wing and tail/bowplane pivot about one, two or three axes in parallel and the fuselage and leeward amas (or, in the tandem configuration, both amas) remain parallel.

The craft of the present invention, although similar in configuration to an airplane, operates in the interface between air and water, deriving both lift and drive from the relative motion of the two media. Consequently, it has more degrees of freedom in the lifting and driving surfaces and trim controls about more axes than would be necessary were the craft operating in a single medium.

The craft of the present invention is a coherent structure composed of lift and drive elements rather than a collection of lift and drive elements strung together with pure drag elements. Some of its features are found, in a comparable but different combination, in the Amick flying boat, the Smith self-launching glider, the Magruder sailing wing and the McIntyre sailplane.

In its first several embodiments, the craft of the present invention is similar in appearance to an aircraft with a high dihedral wing. In a tandem configuration it may, as does the Smith self-launching glider, include an after wing with less dihedral than the forward wing. Like the Magruder sailing wing or the Schweitzer/Drake windsurfer, wings are attached to the fuselage by a joint with one or more axes of rotation. However, the craft of the invention is different from the windsurfer in that the fuselage and wing tip amas pivot under the wings in a parallel disposition such that the roll moments generated by the wings about the fuselage or centerline center of lateral resistance may oppose each other but lift and drive forces complement each other in the configurations shown.

As in the instance of the Amick flying boat, the craft of the present invention in various embodiments is able to roll or pivot about a horizontal longitudinal axis either through the main hull centerboard(s) and center of lateral resistance or through the CLR in the leeward ama/float depending on conditions and specific dihedral of the craft. For example, with a 45° dihedral or perpendicularly disposed port and starboard wings, the craft can rotate about the fuselage CLR, while a craft with a 30° dihedral and maximum drive at 30° roll about the leeward ama can be trimmed to pivot about the leeward ama CLR.

The multiplicity of possible trim adjustments could present a problem of manageability; however, it is anticipated that, for a given course of sail, some of the adjustments can be set and only a few trimmed constantly. In general, variation is through small angles and some are not precisely critical, as is the case with, for example, a keel boat heeled to 30°.

In other embodiments, the craft of the present invention resembles the McIntyre sailplane in either a catamaran or trimaran configuration. It is different in that the cross arms are lifting surfaces, the sails are wing sails and the hulls may have vertically as well as laterally lifting hydrofoil appendages.

The craft of the invention includes means for varying and/or adjusting the incidence angle of the port and starboard wings and tailplanes either together or independently relative to the horizontal plane and to the relative angle of the wind, means for varying and/or adjusting the angle of the centerline of the wing configuration relative to the-centerline of the hulls, and means for varying the angle of the wing configuration relative to the vertical, and for varying the incidence angle of the tailplane relative to and independently of that of the main wing configuration.

The craft of the invention may include articulation of any of the wing surfaces in a chordwise direction, so as to vary the surface's lift coefficient independently of its angle of incidence.

Wings to pivot as described are mounted on an axis perpendicular the datum waterline (DWL) of the main (center) hull, a transverse spanwise axis and a longitudinal horizontal axis (which may be the fuselage itself).

On any of the embodiments, wings can be rotated or parallelograms of wings and amas can be skewed by a variety of means or combination of means such as: drum winches and cables, operated manually or by servo motors, or tillers, or steering gears with wheel or joystick or servo motor operation. Similarly, wings can be trimmed about their spanwise axes by a variety of means or combination of means. With the single wing or wing and bow or tailplane configuration, it may be preferable to have each ama pivot about a single axis perpendicular to the plane defined by the chordline and spanwise axis of the wing.

In some embodiments, wings may be mounted on pylons above the fuselage so as to lower the payload and center of gravity of the craft and improve its transverse stability. The length (height) of the pylons may be varied by mechanical means. The weight of the fuselage may be varied by flooding or emptying of water tanks.

Angles of attack of vertically or horizontally lifting hydrofoil surfaces may be varied and foils may be retracted or adjusted in area or extended as the craft fuselage and/or amas are lifted clear of the water's surface. The angle variations are essential in enabling the wings to drive the craft as a sailing boat and provide vertical lift to allow the fuselage to fly clear of the water's surface with only minimal ama and lateral resistance in the water.

Hydrofoils/leeboards/centerboards on the fuselage/amas may also be curved or hooked so as to provide optimum horizontal and vertical lift for the given conditions. They may also be compound foils angled or configured to generate lateral and/or vertical force as needed.

Port and starboard wing/tailplanes/bowplanes may have dihedral angles relative to the horizontal of between 0° and 45°, but the dihedral angles of the main wing and the secondary wing/plane do not necessarily have to be the same. The wing dihedral angle of a given craft may be variable by mechanical means for different wind conditions.

The craft may also be designed without the tail/bow plane or secondary wing so that balance and steering are accomplished by trim and pivoting of a single wing. The craft may also have more than two or a multiplicity of port and starboard wing/tail/bow plane/elements.

The wing configuration may also be used in conjunction with wheels for land sailing or ice runners instead of hulls and amas. The port and starboard wing spans may also have a secondary inflection point giving them a double dihedral angle with the amas mounted at those secondary inflection points. A double dihedral would limit the roll angle but might have some structural benefits. The angle between the vertical windward span and the leeward span defines the maximum roll angle.

The craft may have an auxiliary motor with an air propeller to facilitate free flight and or fuselage lift-off.

The craft may be any size from a small scale model, self-tending and/or radio controlled, to a payload or multiple passenger carrying version. The choice of materials will be determined by the size and function of the craft and vice versa. It can be built using aircraft or light weight marine construction techniques in wood, various composites or aluminum. Wings/sails may also consist of some sort of framework with a fabric skin and/or inflatable elements.

The craft may have a gimbaled cockpit or fuselage, or the wing assembly may be mounted on a hinge or cylinder that encircles and rotates about the longitudinal axis of the fuselage so that the fuselage remains upright as the wings rotate from one tack to another.

In embodiments which have high dihedral wings, a compression strut may link the port and starboard wing tips of the craft, to help preserve the angular relationships under load, and provide for varying the dihedral of the wings.

In some embodiments, the craft of the invention may have wings of small, 0°, or negative dihedral angle and canted, symmetrical and articulated or flexible wingsails projecting from each of the two amas and optionally connected by a central "bridge" or double pivot for rigidity. The wingsails are angled so that the capsizing moment produced by the parallel driving forces is opposed by an equal righting moment developed by the vertical force vectors. It may also consist of a catamaran craft with amas and the above mentioned symmetrical sails but no central fuselage.

In a preferred embodiment, the catamaran would be similar to the McIntyre sailplane developed by Elco Works, except that it would have aero and/or hydro lifting surfaces in addition to buoyancy and dynamic lift developed by the hulls. In a heavy displacement configuration, the twin hulls could be fixed in relation to each other, and the rig/wingsails could pivot in the same parallelogram disposition by means of the bases of the wingsails moving on tracks that would follow the locus of corners of a skewable parallelogram on the deck of the craft.

Further variations include any of the above mentioned small dihedral craft with tandem or multiple driving wingsail systems. The after "sails" in the tandem craft would be slightly higher than the forward ones to avoid downwash from the forward wings. Successive wings would resemble a "telescoping" of the triangles. Because of the dynamic stability of the system, it could have commercial as well as recreational applications. The possibility of furling or retracting fabric or inflatable wing sails or a rig that could be lowered altogether further enhances its seaworthiness.

Any of the aforementioned craft could use sensors, similar to Christopher Hook's or Greg Ketterman's forward ski sensors, ahead of the hulls to adjust trim angle of all vertical lifting surfaces with wave motion of the water surface.

A triangle rig may also be used as a method of propulsion for a wide beam single hull ship such as, for example, a 200,000 dwt or larger VLCC. In this embodiment of the present invention, there is no need to be limited by the complication and expense of including means for skewing the rig. In this embodiment, the triangle configuration wing sails are mounted in tandem in a fixed (non-skewing) arrangement to the port and starboard rails or outer shell of a single hull ship. Preferably, a platform is provided at the top of the rig for use appropriate to the ship's requirements.

The opposed canted wing sails and center of effort that is very low in proportion to the length of the vessel will keep the heeling moment to a minimum. It is intended for vessels operating at speed/length ratios of less than 0.5, that is, large (700 ft.–1300 ft. in length), low speed (under about 17 knots) vessels. Sail propulsion for these ships therefore acts as an auxiliary to the ships engines, and the size of the rig is small in relation to length of the ship. Also, the height of the rig may be limited by bridge heights in places such as the Verrazano Narrows. In average true wind speeds of, say, 25 knots, large ships, with an operating speed range of around 15 knots, will have an apparent wind angle forward of the beam on most points of sail. Consequently, wing sails are appropriate for these vessels.

Because the ship is under-rigged in the conventional sense, the side force generated by the sails will be small in proportion to the opposing side force generated by the hull canoe body. Consequently, the lateral plane of the flat sided hull will provide adequate side force for windward performance. The center of lateral plane of such a craft will vary in a manner that its precise location in relation to the rig is neither critical nor controllable, so that the adjustment of the longitudinal center of effort of the rig by skewing is not important.

The driving (lifting) surfaces are also small in proportion to the major aerodynamic drag elements on the vessel, namely the superstructure and the standing rigging. It is important, therefore, to minimize that aerodynamic drag by fairing the superstructure and streamlining the rigging.

Platforms at the top of each of the rigs are preferably provided for mounting swiveling wind turbines and/or cranes for cargo handling. The platforms may also be used to mount other mechanisms or structures such as control mechanisms, a crow's nest or an observation platform, for example. The turbines can be used to directly or indirectly power the ship's main plant and may drive underwater propellers through a flexible hydraulic drive or generate electric power transmitted to the ship by cables led inside the masts. Smaller secondary turbines aft of the primary ones can, with proper ducting, develop power from the vortices off the tips of the wing sails.

Primary trim will be variation of angle of attack about the spanwise axes. Adjusting camber to correspond to the direction of aerodynamic lift is a secondary consideration. There are numerous possible arrangements for varying the camber of these initially symmetrical chord foils and for retracting them, furling them or in any way "shortening sail".

The specific choice of material and mechanical system for camber variation will depend on the precise wing section and the extreme conditions to which it is designed. It will also depend on cost versus fuel savings, and safety and durability considerations. A wing sail composed of rigid sections would avoid some of the control, fatigue and safety problems due to flutter inherent in a flexible fabric sail. Feathering the wings may produce less wind resistance and negative force than a "bare pole" or unstreamlined though smaller profile.

The principles of the invention will be further discussed with reference to the drawings wherein preferred embodiments are shown. The specifics illustrated in the drawings are intended to exemplify, rather than limit, aspects of the invention as defined in the claims.

As will be readily understood without need for multiplying the views and description, any of the features which are described in relation to one of the embodiments can be provided on others of the embodiments instead of or in addition to the features shown and described herein relative thereto.

DETAILED DESCRIPTION OF THE PREFERRED EMBODIMENTS

Figure 1:
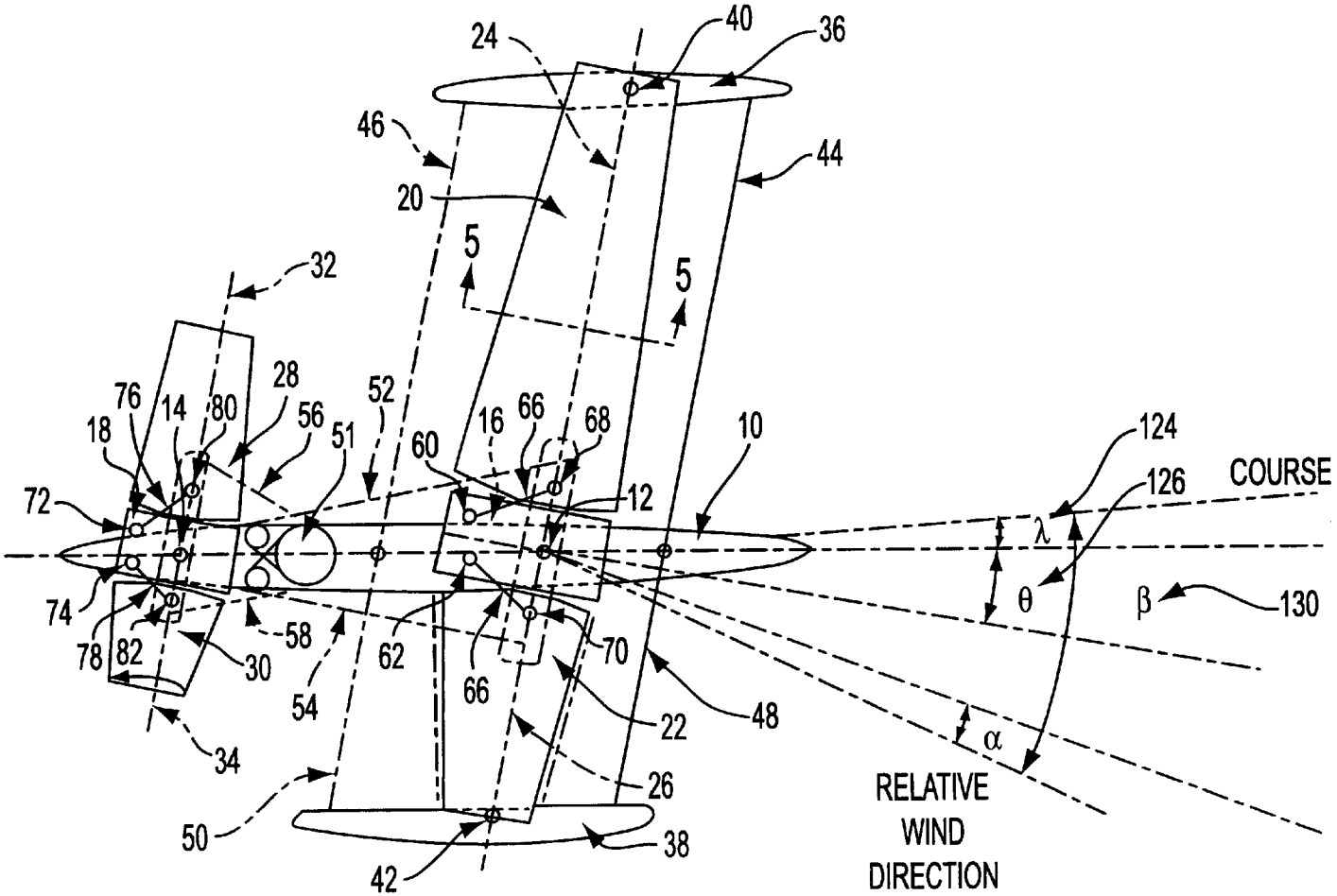
FIG. 1 is a top plan view of a first embodiment of a wind-powered air-water interface craft constructed in accordance with the principles of the present invention, depicted while on a starboard tack heading.
Figure 2:
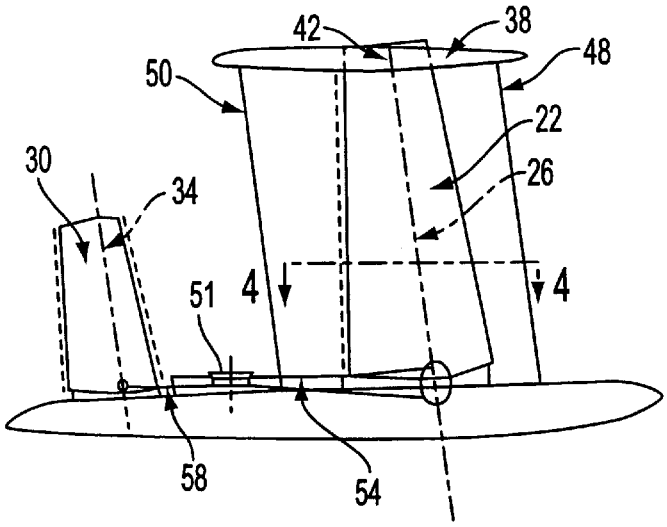
FIG. 2 is a right side (i.e., starboard) elevational view thereof.

The basic elements of the wind-powered air/water interface craft having adjustable wing angles are shown in FIG. 1. These basic elements and the essential geometry of their configuration are shown with certain variations in each of the different views and embodiments that follow.

In FIG. 1, the fuselage, 10, is a narrow, aerodynamically streamlined, planing hull form. The forward pivot axis, 12, and the aft pivot axis, 14, are pins, axles, tubes or rods, designed to withstand maximum loads developed by the wings, and set in the centerline of the upper surface of the fuselage or in the centerline of a platform mounted on the upper surface of the fuselage. The forward yoke, 16, is mounted on the forward axis and the aft yoke, 18, is mounted on the aft axis with necessary bearings, bushings, etc. so that the yokes with aerodynamic loading on the wings can be rotated freely about the axes. The port (leeward) wing, 20, and the starboard (windward) wing, 22, a mirror image of the port wing, are mounted on pins, axles or spars, port, 24, and, starboard, 26, which are set into the forward yoke in an imaginary plane through or close to the forward pivot axis and perpendicular to the "waterplane" (see definition below) of the fuselage at the same dihedral angle port and starboard, with necessary bearings so that the wings can turn on the pins or axles set in the yoke.

The port (leeward) tailplane, 28, and the starboard windward) tailplane, 30, a mirror image of the port tailplane, are mounted on pins, axles or spars, port, 32, and, starboard, 34, which are set into the aft yoke in an imaginary plane through or close to the aft pivot axis and perpendicular to the "waterplane" (see definition below) of the fuselage at the same dihedral angle port and starboard, with necessary bearings so that the tailplanes can turn on the pins or axles set in the yoke.

The leeward or port ama/pontoon, 36, is mounted on the underside of the tip of the leeward wing element by means of a pivot axis, 40, through or close to the axis of the wing and perpendicular to the plane defined by the chord line of the wing airfoil section and the spar or wing axis. The ama's turning radius is in an imaginary plane parallel to the plane of the leeward wing and its centerline can be held parallel to the centerline of the fuselage by the forward and aft transverse guy wires, 44 and 46.

The windward or starboard ama/pontoon, 38, is mounted on the underside of the tip of the windward wing element by means of a pivot axis, 42, through or close to the axis of the wing and perpendicular to the plane defined by the chord line of the wing airfoil section and the spar or wing axis. The ama's turning radius is in an imaginary plane parallel to the plane of the windward wing and its centerline can be held parallel to the centerline of the fuselage by the forward and aft transverse guy wires, 48 and 50.

The amas may be identical symmetric shapes for ease of construction, or they may be asymmetric mirror image shapes for better hydrodynamic side force.

Cables, 52 and 54, from a drum winch 51 or servomotor, on the fuselage or wing-mounting platform, led forward to wing pivoting arms or cranks projecting out from the yoke underneath and parallel to the wing spar/axes are used to pivot/skew the wings, in plan view, clockwise or counter clockwise.

Cables, 56 and 58, from a drum winch or servomotor, on the fuselage or wing-mounting platform, led aft to tailplane pivoting arms or cranks projecting out from the yoke underneath and parallel to the tailplane spar/axes are used to pivot/skew the tailplane axes, in plan view, clockwise or counter clockwise parallel to the wing axes. Servomotors/winches/tackles, 60 and 62, port and starboard, mounted on the wing yoke and connected by cables/rods/lines, 64 and 66, to cranks/arms, 68 and 70, projecting perpendicularly from the inboard upper surface of the wings, trim the port and starboard wings about their spanwise axes.

Servomotors/winches/tackles, 72 and 74, port and starboard, mounted on the tailplane yoke and connected by cables/rods/lines, 76 and 78, to cranks/arms, 80 and 82, projecting perpendicularly from the inboard upper surface of the tailplanes, trim the port and starboard wings about their spanwise axes.

Asymmetric or symmetric leeboards, 84 and 86, for lateral resistance, on port and starboard amas, may be fixed or may be pivoted or sliding for retraction as necessary. The tandem craft embodiment in FIG. 12 has two leeboards, 88, 90, 92 and 94, in each ama. More than two may also be used for trimming or balancing the craft. Any of the above mentioned leeboards/centerboards/hydrofoils may be articulated, so as to vary the effective camber of the foil, or pivoted in a vertical plane, so as to act as rudders. They may also be curved or extended with crosswise elements, so as to provide vertical hydrodynamic lift as well as lateral. The craft embodiment shown in bow elevation in FIG. 3 has, in the fuselage, one or more symmetric centerboards 87 which also may be fixed or retractable.

Figure 11:
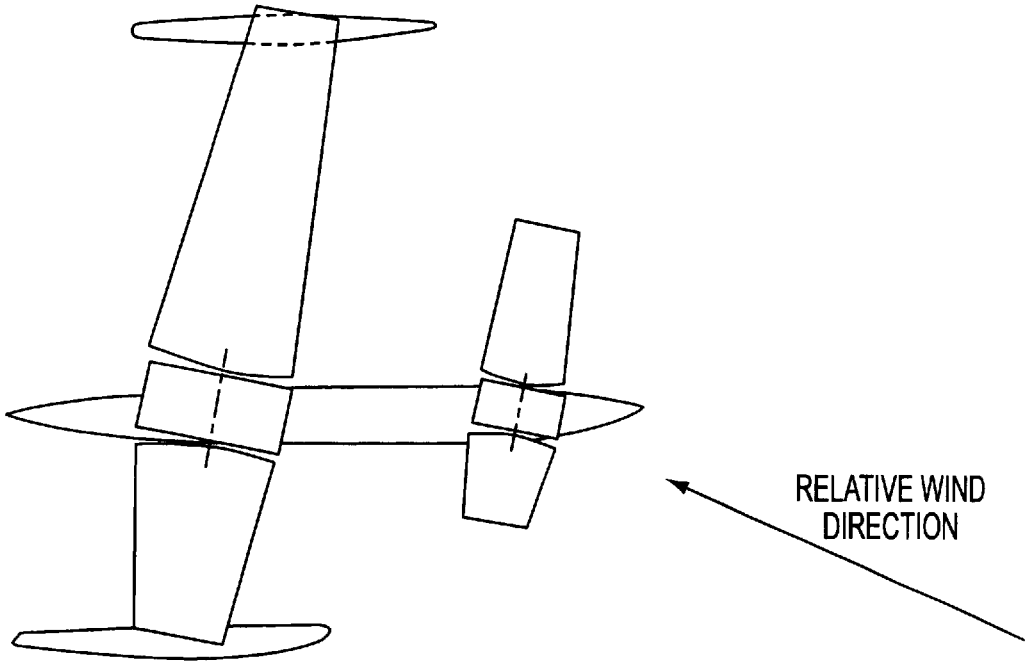
FIG. 11 is a top plan view similar to FIG. 1, but of a second embodiment, providing a canard configuration.

The canard embodiment of the craft in FIG. 11 has all the same features as the embodiment in FIG. 1, except that the steering wings consist of bowplanes forward instead of tailplanes.

Figure 12:
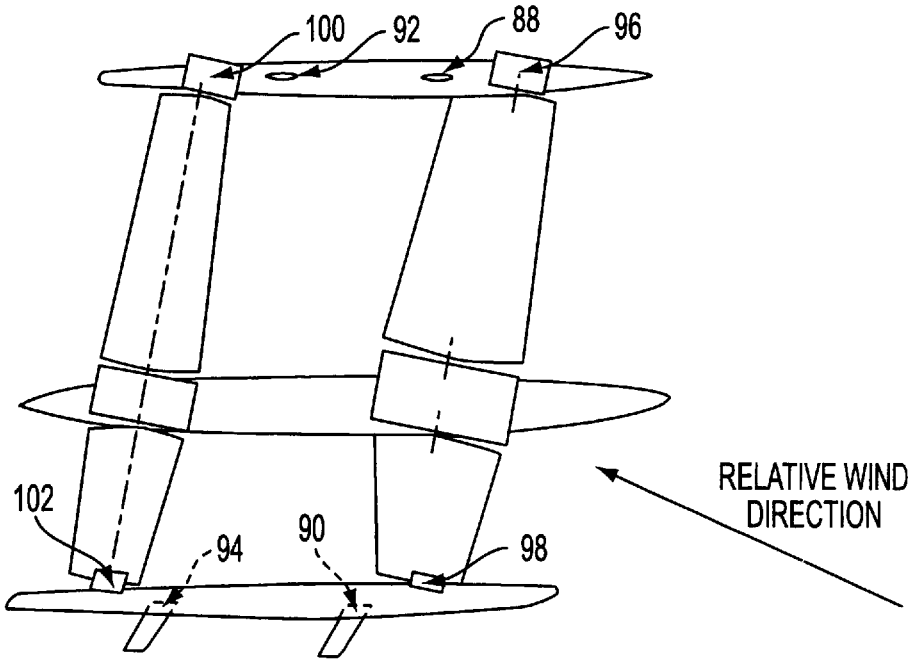
FIG. 12 is a top plan view similar to FIG. 1, but of a third embodiment, providing a tandem configuration.
Figure 13:
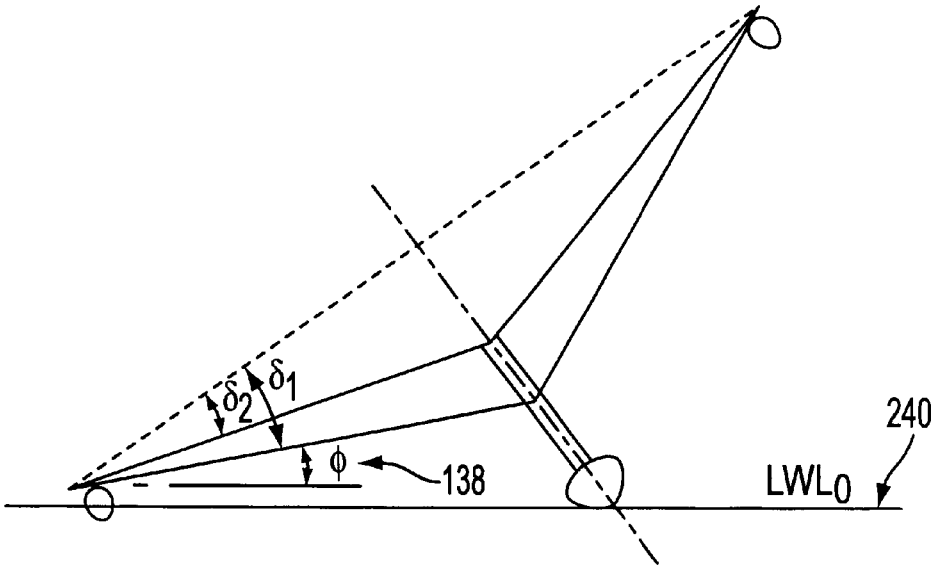
FIG. 13 is a schematic aft elevational view of the craft embodiment of FIG. 12, in which the aft wings are mounted on a pylon above the fuselage hull, the dihedral $\delta_2$ of the aft wings being smaller than the dihedral $\delta_1$ of the forward wings.

The tandem embodiment of the craft in FIG. 12 has the same features except that the forward and aft wings are both full span and are linked by the amas which may be as long or longer than the fuselage. The amas are connected to the wing tips by double pivot axes, 96, 98, 100 and 102, so that the wings may be trimmed independently and concurrently with the rotation of the wings.

Figure 15:
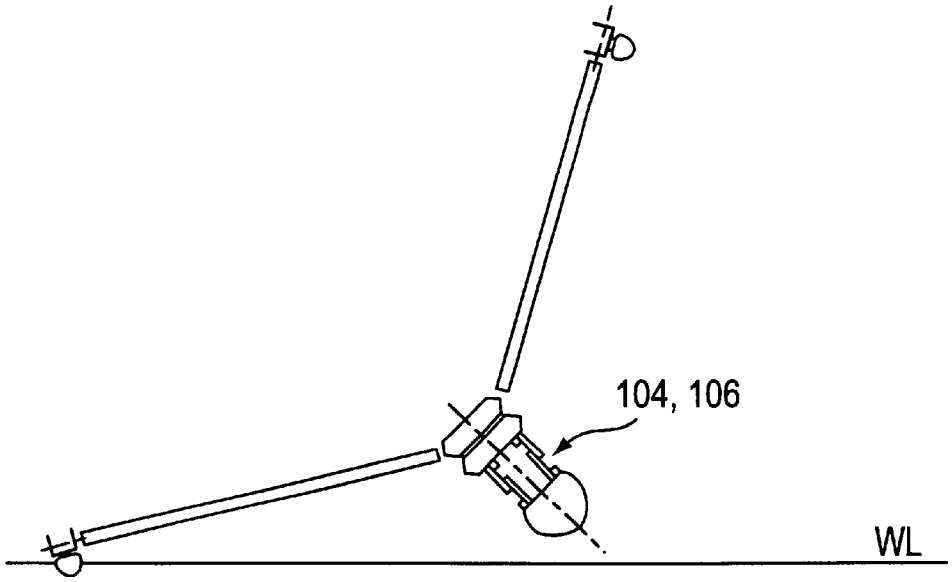
FIG. 15 is a diagrammatic aft elevational view of a fifth embodiment having adjustable-length pylons.
Figure 16:
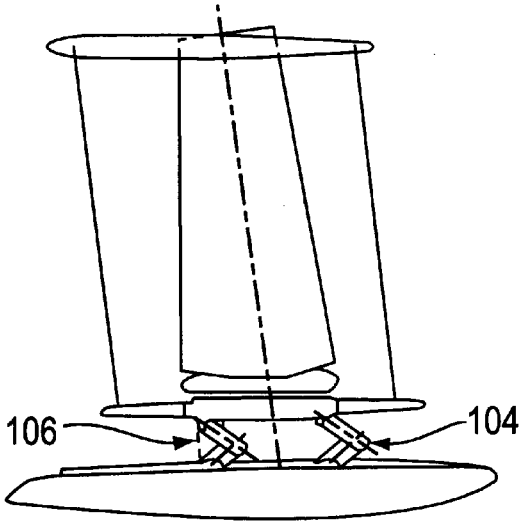
FIG. 16 is a starboard elevational view of a sixth embodiment, which is a tailless craft having an adjustable-length connection between the fuselage or payload and the wing, the fuselage or payload preferably being adjustable in weight by flooding/ballasting or pumping out/emptying tanks or compartments therein.

The embodiments of the craft in FIGS. 15 and 16 have the main pivot axes for the wings connected to the fuselage by fixed or adjustable-length pylons, 104 and 106, so that distance between the wing span center of effort and the fuselage/ballast/payload may be varied to suit the wind strength.

Figure 17:
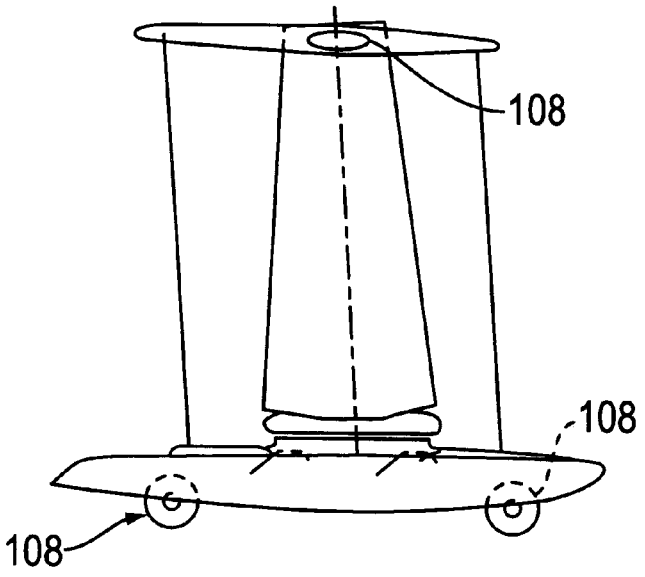
FIG. 17 is a starboard elevational view, similar to FIG. 16, but of a seventh embodiment, which is a tailless craft with wheels for landsailing in place of amas/floats.
Figure 18:
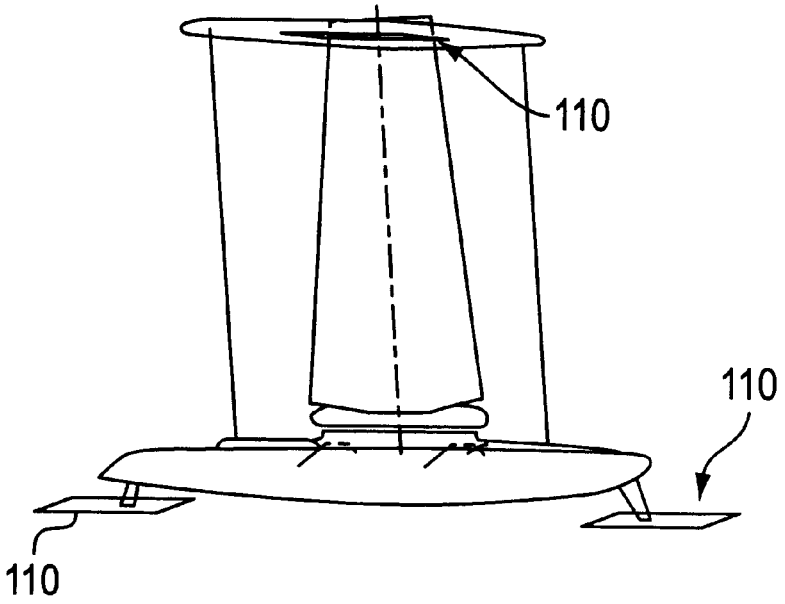
FIG. 18 is a starboard elevational view, similar to FIG. 17, but of an eighth embodiment, which is a tailless craft with runners for ice sailing in place of wheels.

In FIG. 17, wheels, 108, fixed or retractable, on the port and starboard amas and the fuselage, in combination with or as an alternative to leeboards and centerboards, provide for a landsailing or amphibious embodiment of the craft. Similarly, in FIG. 18, ice runners, 110, provide for an ice sailing embodiment.

Figure 19:
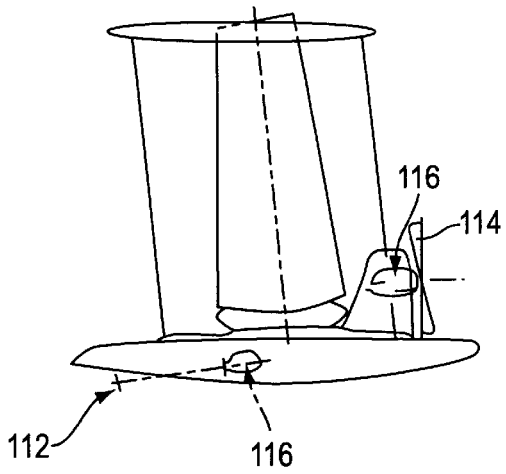
FIG. 19 is a starboard elevational view, similar to FIG. 16, but of a ninth embodiment, which is a tailless craft with an auxiliary motor and air propeller.

In FIG. 19, a water propeller, 112, and/or an air propeller, 114, driven by a motor, 116, provide an option of auxiliary power either on the water or in air.

Figure 20:
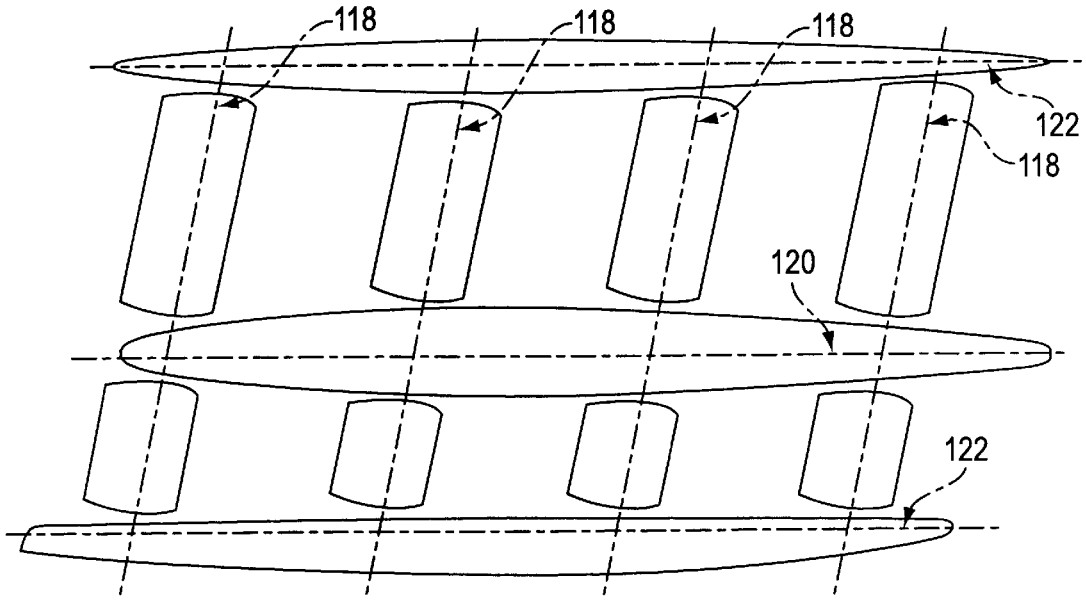
FIG. 20 is a diagrammatic top plan view showing a tenth embodiment, which is a tandem craft with a multiplicity of wing elements.

FIG. 20 shows the axis lines, 118, of the multiple wing elements and, 120 and 122, of the fuselage and amas in the multiple tandem configuration.

Figure 21:
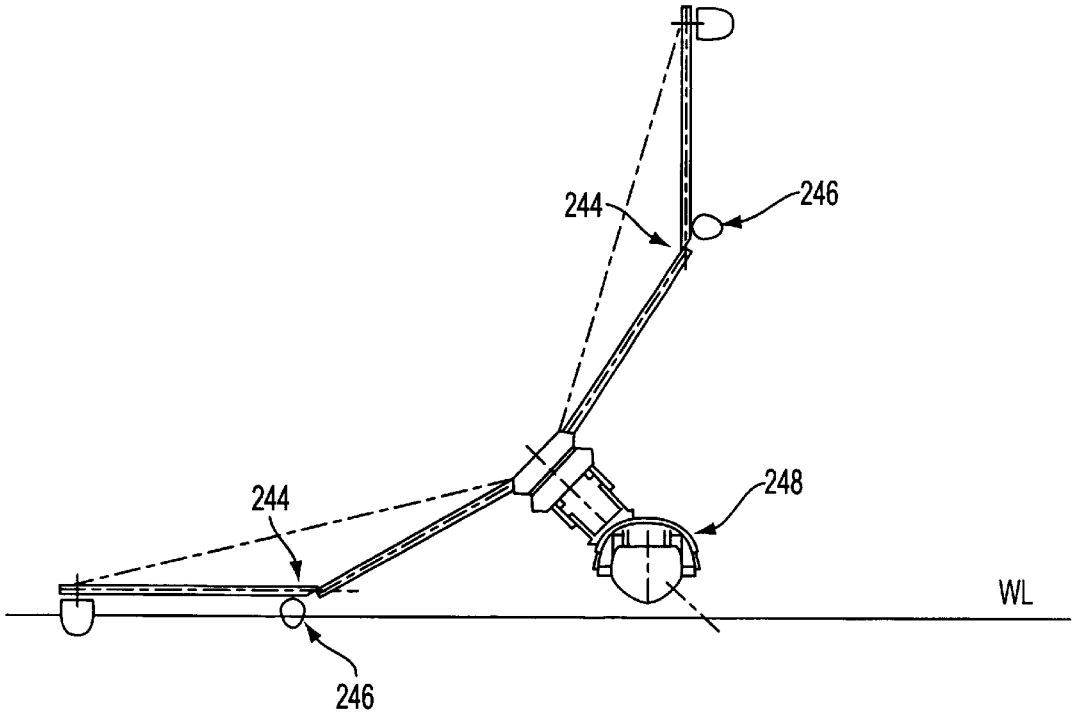
FIG. 21 is a front (i.e. bow) elevational view of the craft embodiment of FIG. 14 in which the craft has a gimbaled cockpit or fuselage and a secondary inflection point and auxiliary ama on each wings.

FIG. 21 shows the secondary inflection points, 244, and amas, 246, and a cradle or framework, 248, in which the fuselage is gimbaled so that it remains upright.

Figure 22:
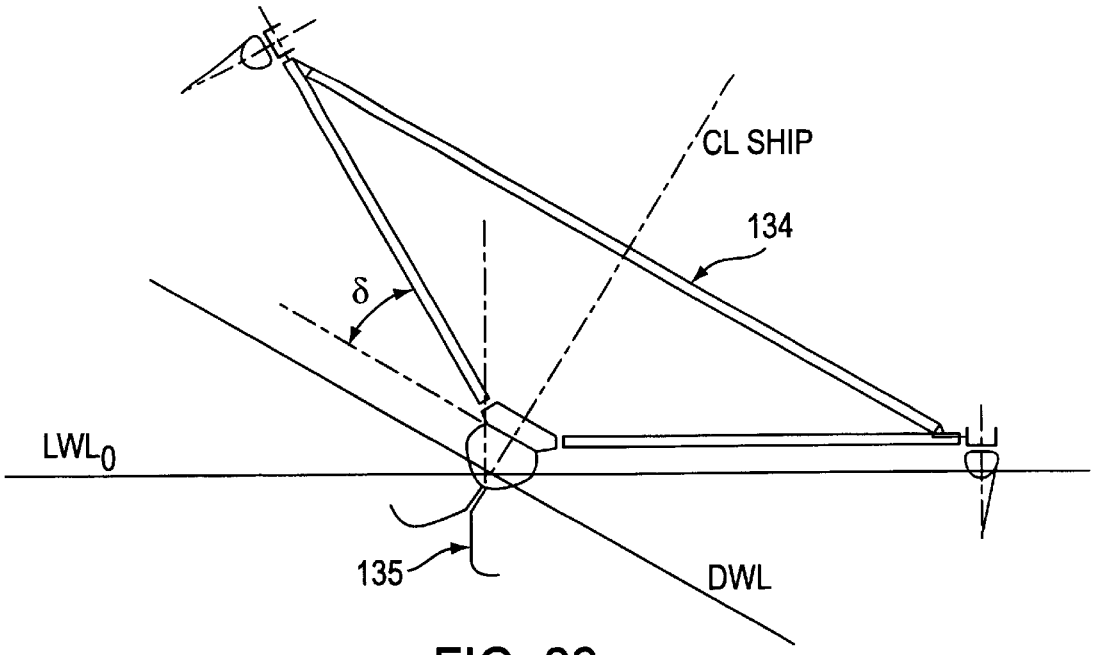
FIG. 22 is a front (i.e. bow) elevational view of the craft embodiment of FIG. 14 in which the craft has a compression strut linking the port and starboard wing tips of the craft and a compound laterally and vertically lifting hydrofoil surface.
Figure 23:
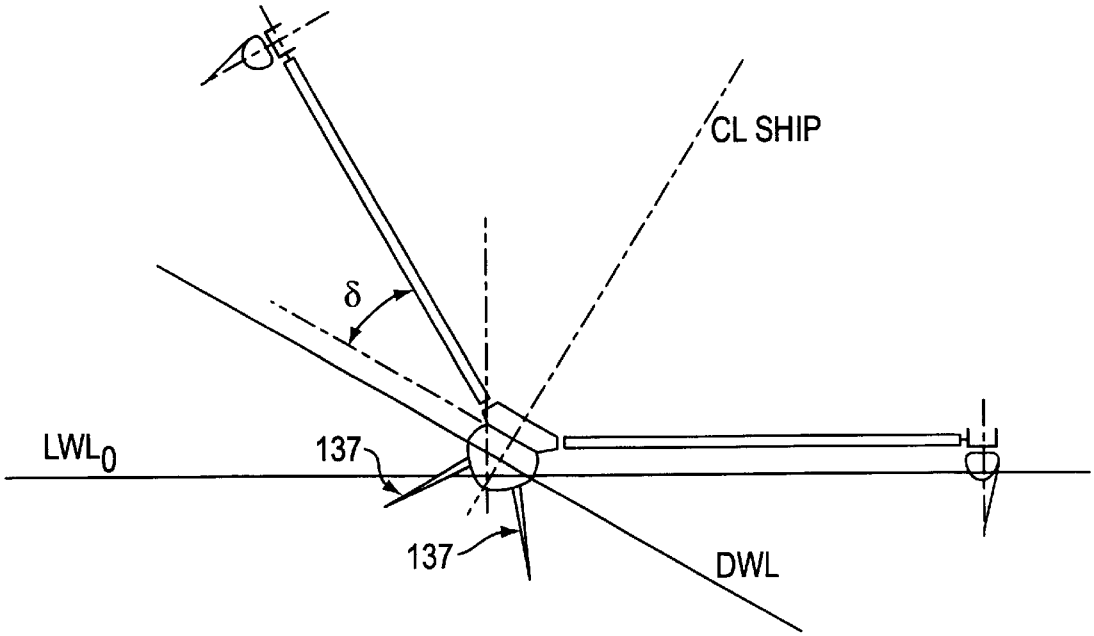
FIG. 23 is a front (i.e. bow) elevational view of the craft embodiment of FIG. 14 in which the craft has angled leeboards in the fuselage.

FIG. 22 shows a compression strut, 134, linking the port and starboard wing tips of the craft as well as a compound laterally and vertically lifting hydrofoil surface, 135. FIG. 23 shows angled leeboards, 137, in the fuselage as well as the amas.

Figure 14:
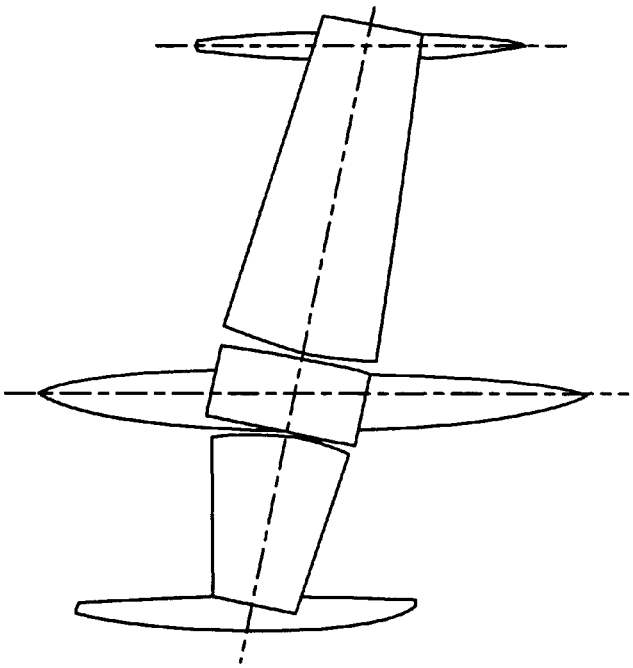
FIG. 14 is a top plan view, similar to FIG. 1, but of a fourth embodiment, providing a tailless configuration with amas pivoting only about an axis perpendicular to the wing plan.
Figure 24:
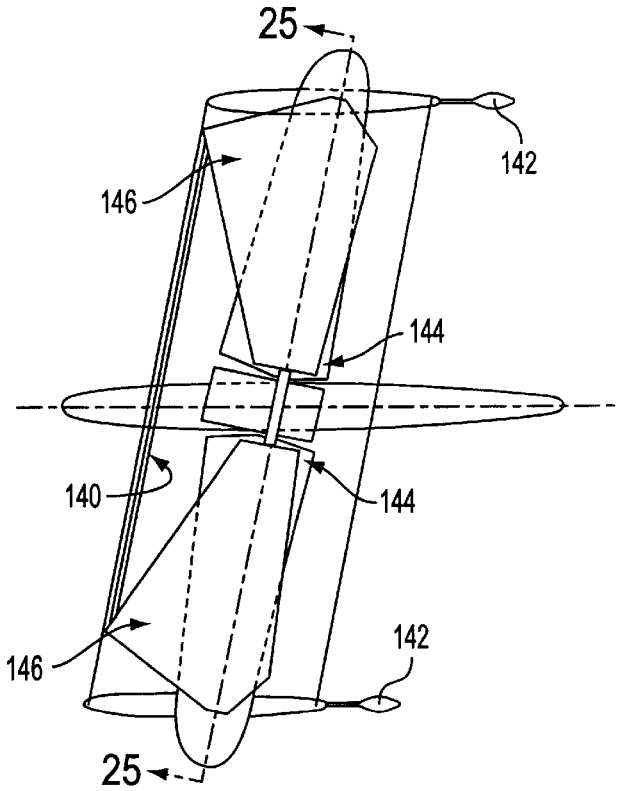
FIG. 24 is a top plan view showing, on starboard tack, an eleventh embodiment, which is a tailless craft with horizontal wings or wings with 0° or negative dihedral and canted, symmetrical wing sails projecting from each of the two amas, and forward planing or ski type sensors for controlling the trim of the wing/cross arms and under water hydrofoils.

FIG. 24 shows a plan view of an eleventh embodiment of the craft of the invention. It is similar to the craft of FIG. 14 except that its wings, 144, are approximately horizontal, i.e. of small, 0°, or negative dihedral angle, which provide essentially vertical lift for the purpose of reducing hydrodynamic drag. Separate canted wingsails, 146, projecting from each of the two amas, provide the driving force. Trim of port and starboard wingsails is maintained parallel by means of a rigid connecting rod, 140, between the trailing edges of the two wingsails. The craft also has forward ski type sensors, 142, that control the trim of the wing cross arms and the under water vertically lifting hydrofoils. The planform parallelogram is mechanically the same as in previously mentioned embodiments and the wingsails have similar features.

Figure 25:
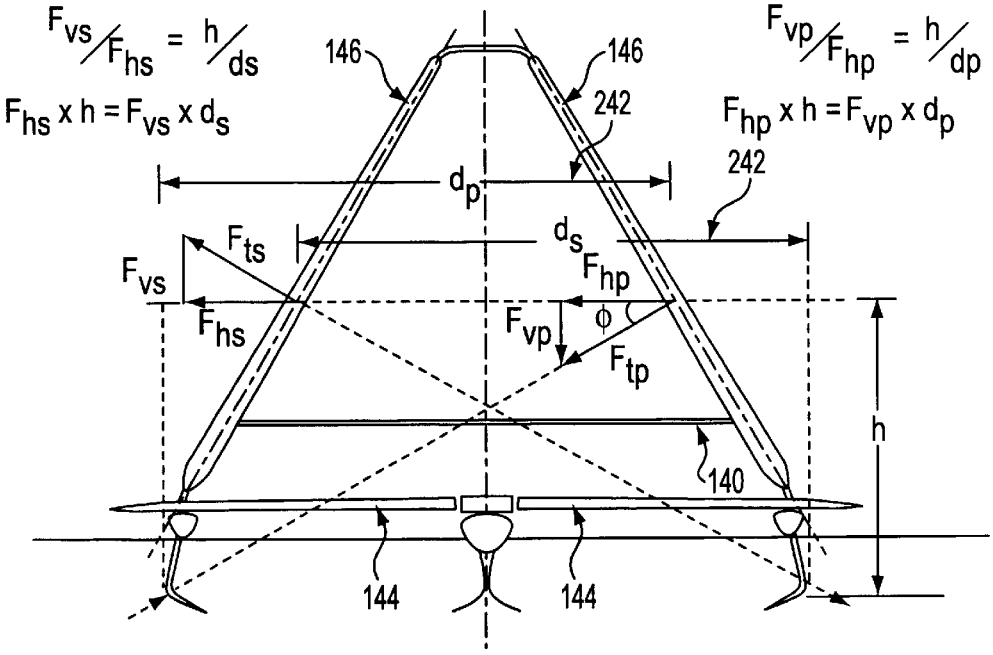
FIG. 25 is an aft looking diagrammatic cross-sectional view taken on line 25—25 of FIG. 24, showing the 0° or negative dihedral and canted, symmetrical wing sails, and the relationship of forces and moments in transverse equilibrium.

The diagrammatic cross-sectional view in FIG. 25 illustrates the relationship of any of the previously mentioned planforms (views taken from a plane perpendicular to the centerplane of the fuselage) to this eleventh embodiment. It shows the approximately horizontal wing cross arms, 144, and the canted wingsails, 146, projecting from each of the two amas. It also shows the relationship of forces and moments which will be further discussed in the section of this description on forces and moments.

Figure 26:
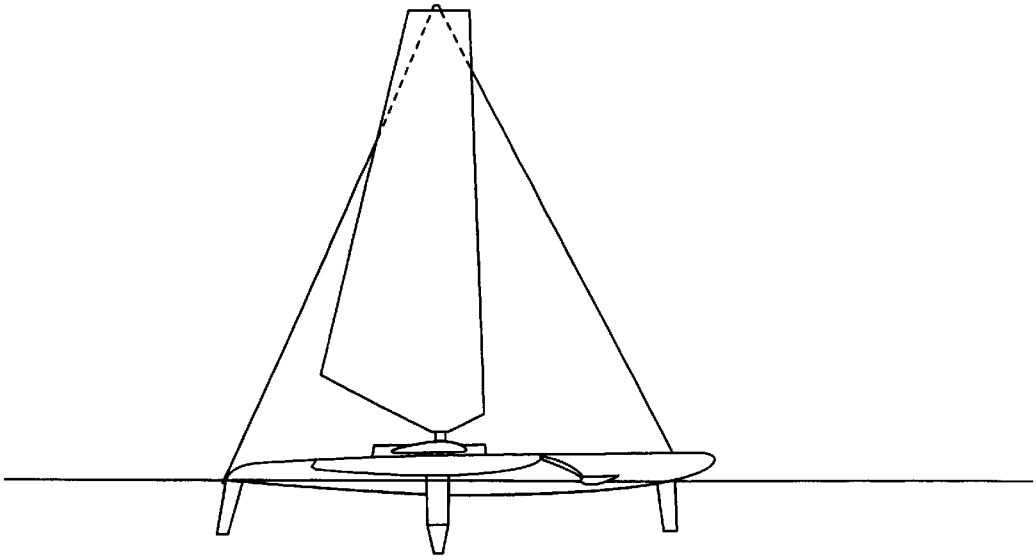
FIG. 26 is a right side (i.e. starboard) elevational view of the craft of FIGS. 24 and 25 head to wind.

The starboard elevational view in FIG. 26 shows the taper in the canted wingsails for reducing weight aloft. The craft is head to wind, i.e., the relative wind angle is 0°.

Figure 27:
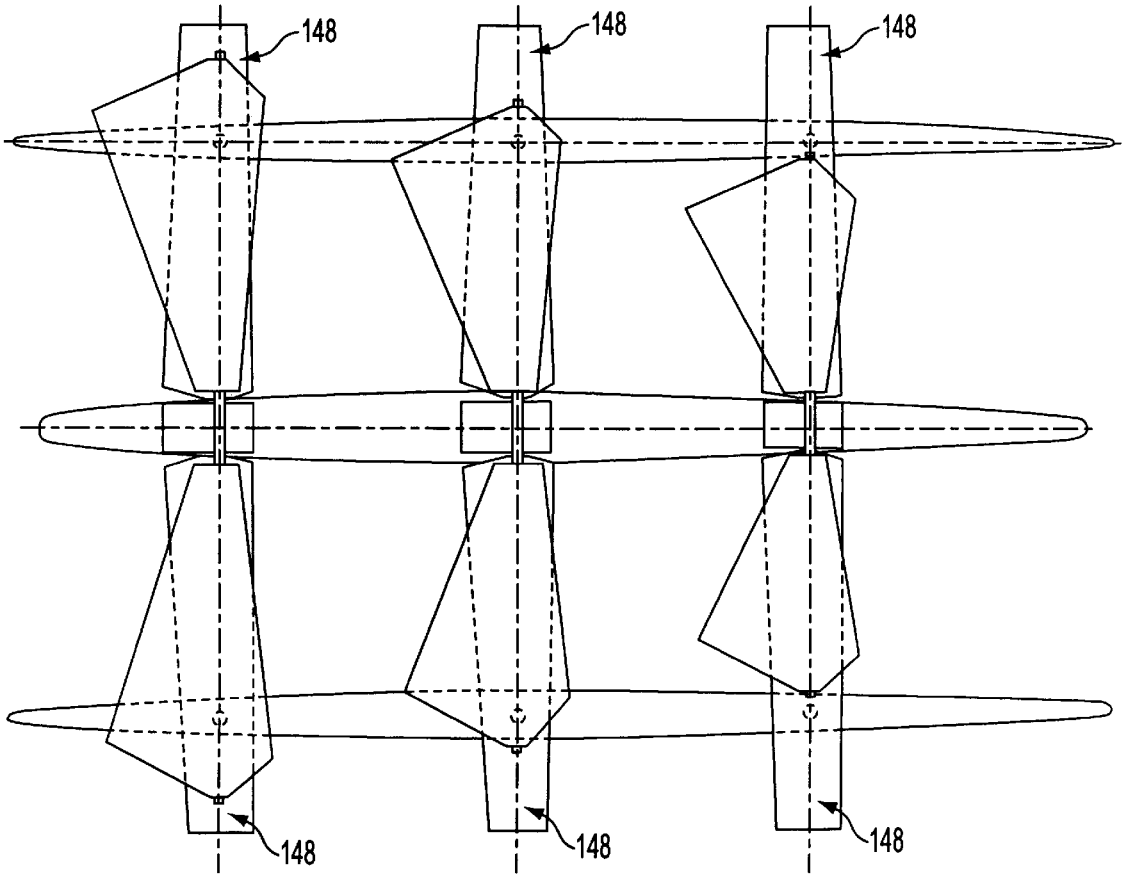
FIG. 27 is a diagrammatic plan view, similar to FIG. 24, but of a twelfth embodiment, which is a tandem craft with the "triangle" rig, shown trimmed head to wind.

The diagrammatic plan view of the tandem embodiment in FIG. 27 shows how the after wingsails are set outboard of the forward sails so as to avoid downwash from them and have clear air flow. The horizontal wing tips, 148, may extend outboard beyond the sides of the amas to provide additional vertical lift and a wide enough base for aftertriangle rigs. The craft is head to wind, i.e., the relative wind angle is 0°.

Figure 28:
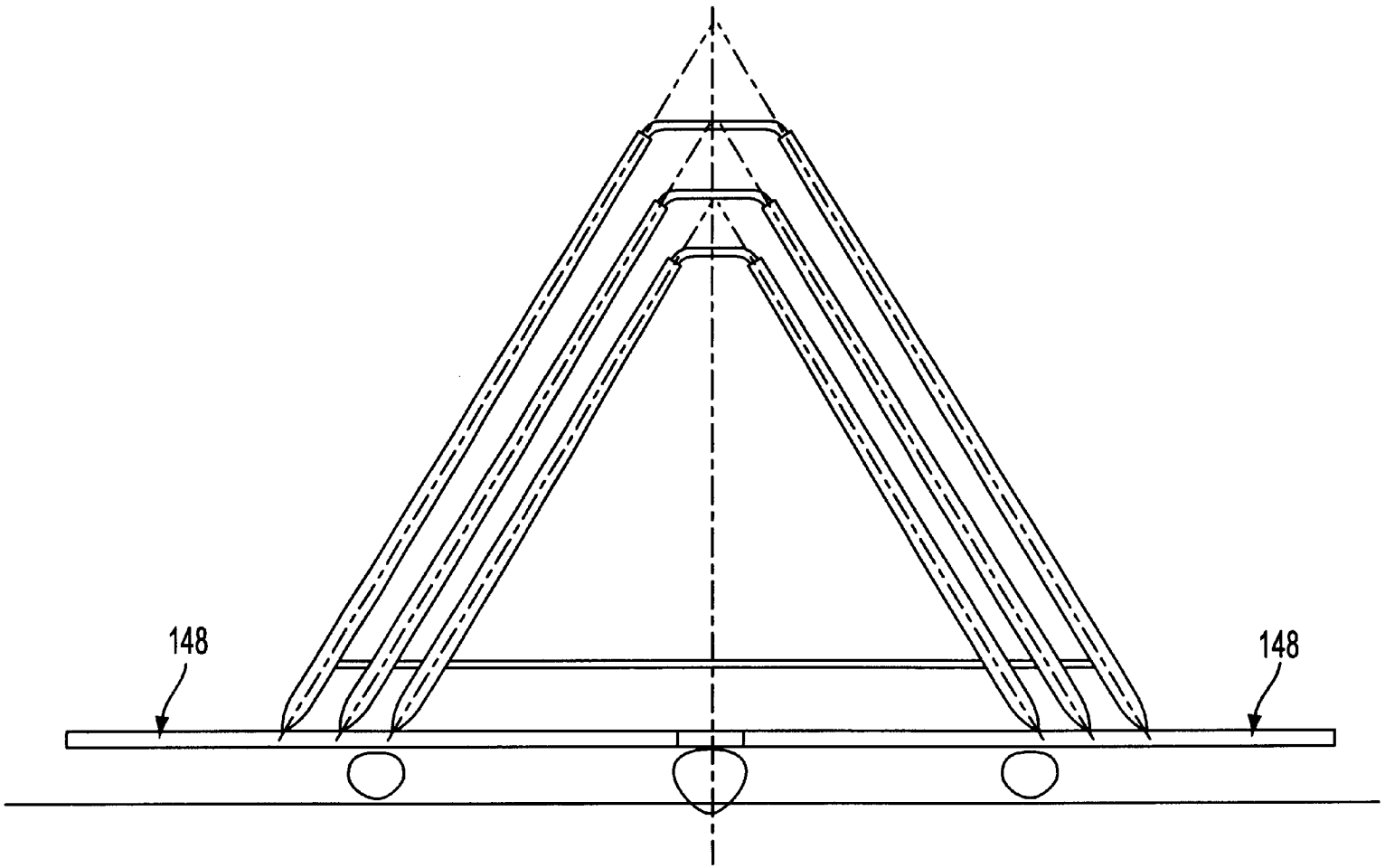
FIG. 28 is an aft looking elevational view thereof.
Figure 29:
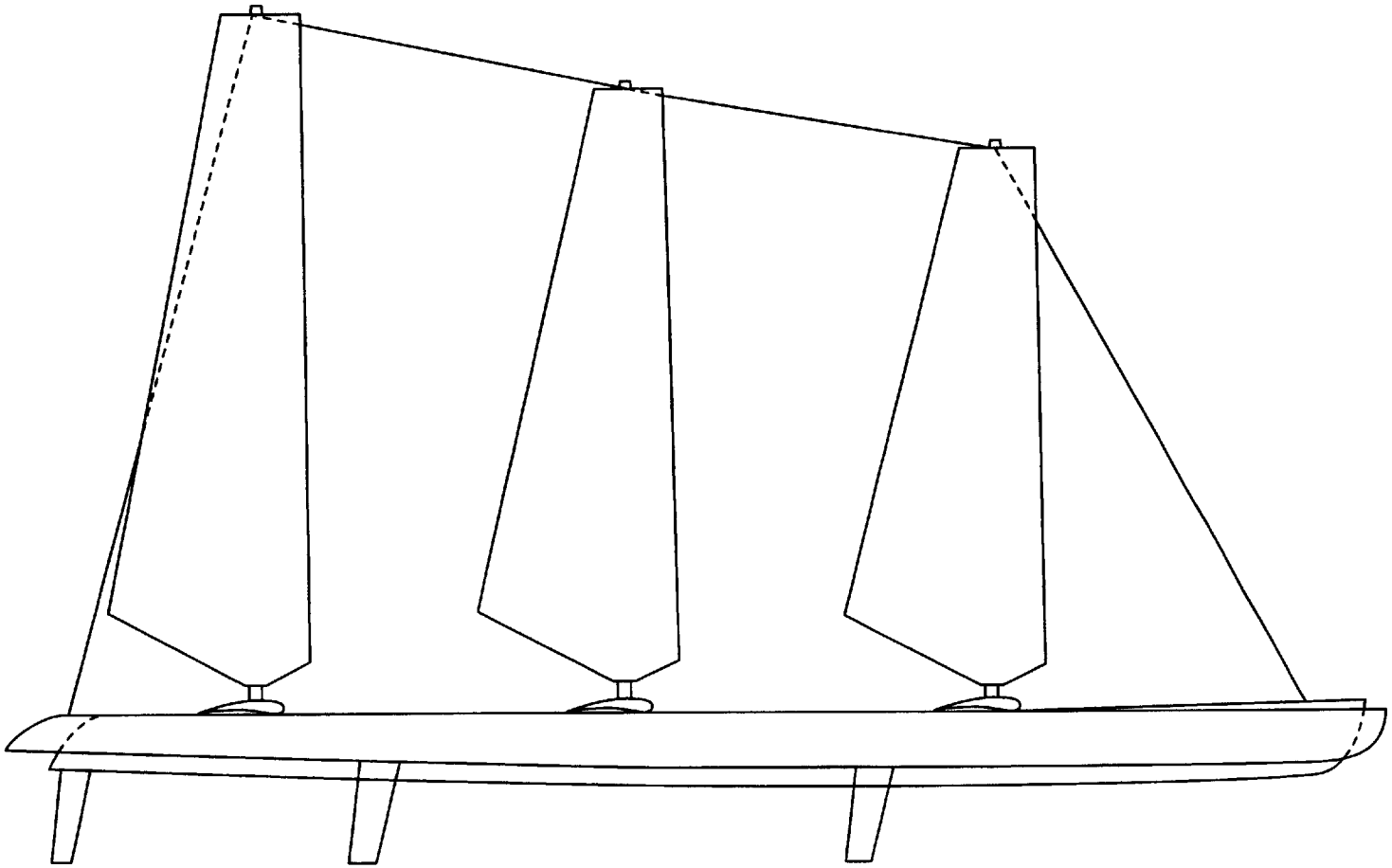
FIG. 29 is diagrammatic starboard elevational view thereof.

The aft looking elevational view in FIG. 28 and the diagrammatic starboard elevational view of FIG. 29 show how the after wingsails are also set above the forward wingsails so as to avoid their downwash.

Figure 30:
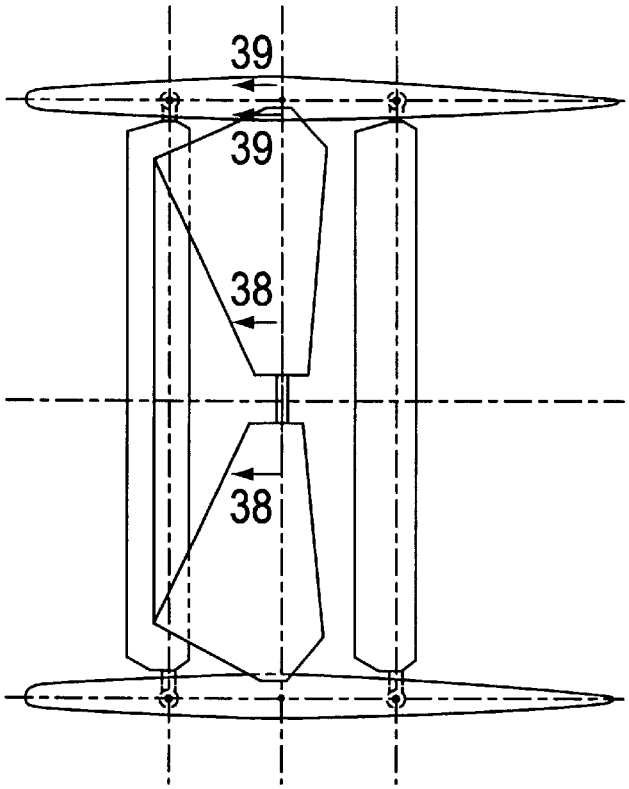
FIG. 30 is a top plan view, similar to FIG. 27, but of a thirteenth embodiment, which is a catamaran craft with two side hulls or amas, but no central fuselage.
Figure 31:
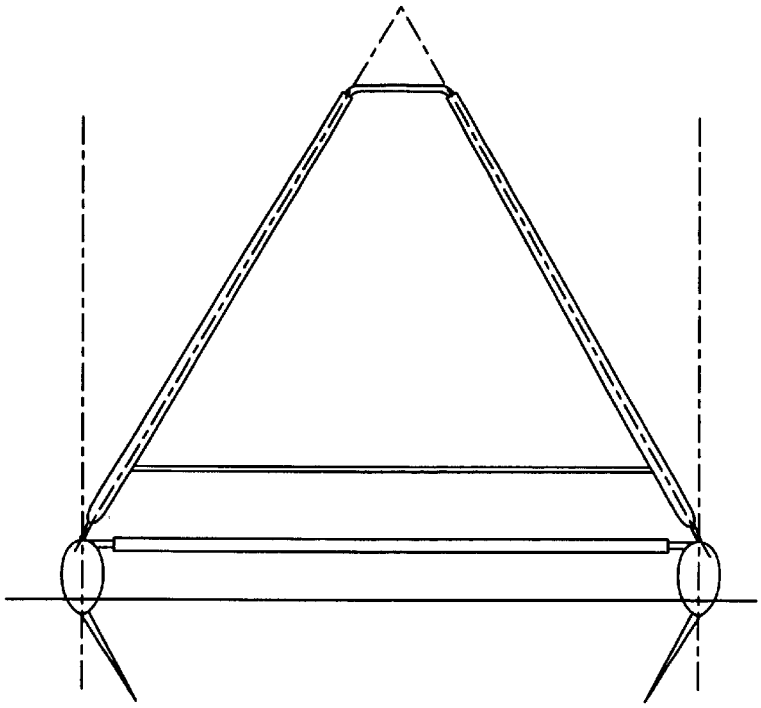
FIG. 31 is an aft looking cross-sectional view, similar to FIG. 25, but of the catamaran.

The catamaran craft of FIGS. 30 and 31 is similar to the McIntyre sailplane but with wingsails and trimmable, lifting, skewable crossarms linking the two hulls.

Figure 32:
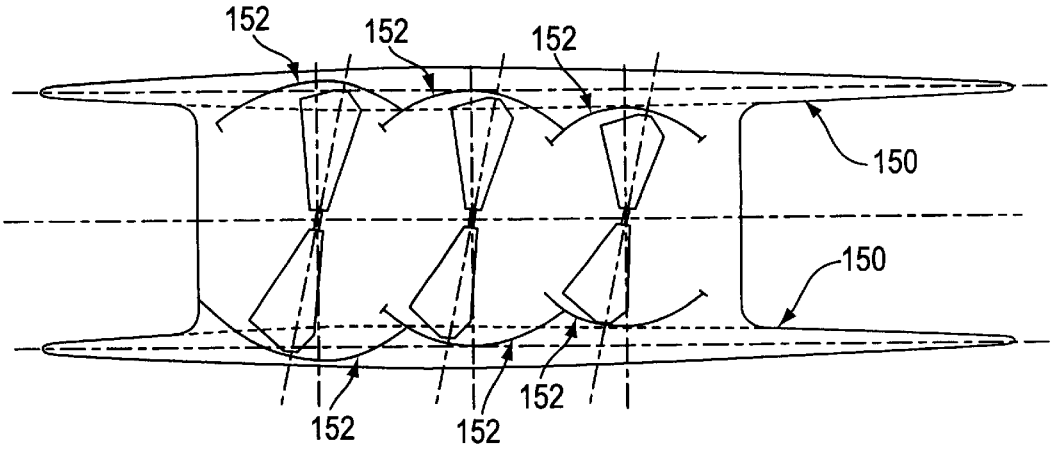
FIG. 32 is a top plan view of a catamaran ship with fixed twin hulls and triangle wingsails that are skewed on tracks on deck.

FIG. 32 shows a catamaran ship with twin fixed hulls, 150, and triangle rigs pivoting on tracks, 152, on deck. The ship could be a conventional catamaran or a SWATH (submerged waterplane area twin hull) or wide beam single hull ship.

Figure 33:
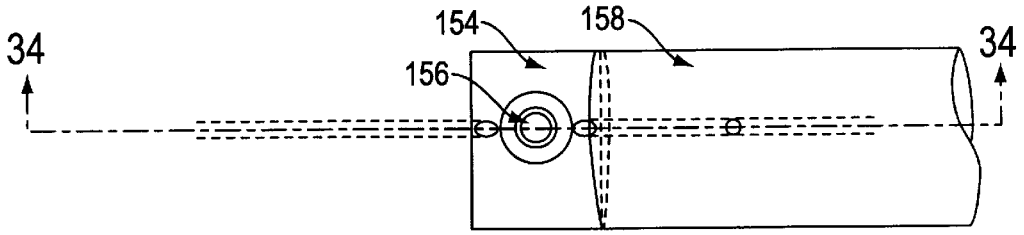
FIG. 33 is a top plan view of a rotating yoke pivot on the central fuselage.

FIG. 33 shows the yoke base, 154, the wing rotation pivot pin, 156, and the wing, 158, in plan view.

Figure 34:
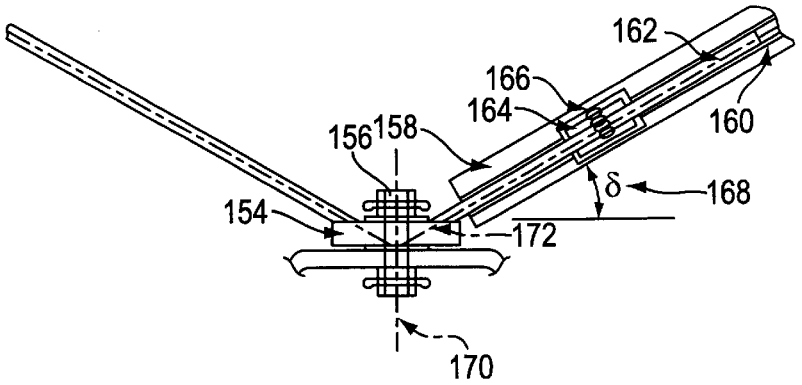
FIG. 34 is an aft looking cross-sectional view taken on the line 34—34 of FIG. 33 of the port side of a symmetrical yoke for a dihedral angle of $\delta$°.

FIG. 34 shows, in cross section, the same elements as FIG. 33 and also the wing spar tube, 160, the wing axle, 162, and collar, 164, with clevis pin or set screw, 166. The wing dihedral is some angle, δ, 168, between 0° and 90°. The "horizontal" rotation pin, 156, is at the intersection of the ship centerline, 170, and the wing axis lines, 172, through the center of pressure of the wings. The axle as shown only extends for part of the wing span but could extend out to and be continuous with the pivot axle at the wing tips.

Figure 35:
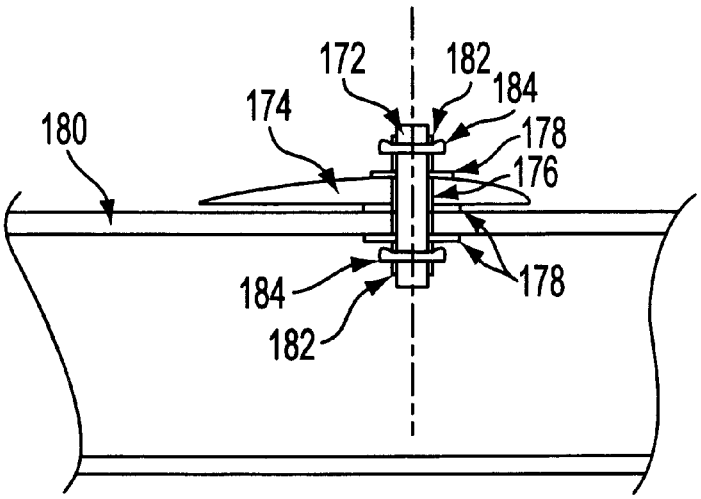
FIG. 35 is a right side, i.e. starboard, sectional view of a single pivot axis wing tip.

In FIG. 35, the pivot pin, 172, is at the ama axis of rotation, so that the ama rotates in a "horizontal" plane under the wing tip, 174, and in a "vertical" plane with the wing. The pivot pin rotates inside a bushing or compression tube, 176. Washers, 178, provide bearing surfaces and separate the underside of the wing from the top of the ama deck or platform, 180. Removable collars, 182, and clevis pins, 184, hold the pivot pin in place and provide for easy assembly and disassembly.

Figure 36:
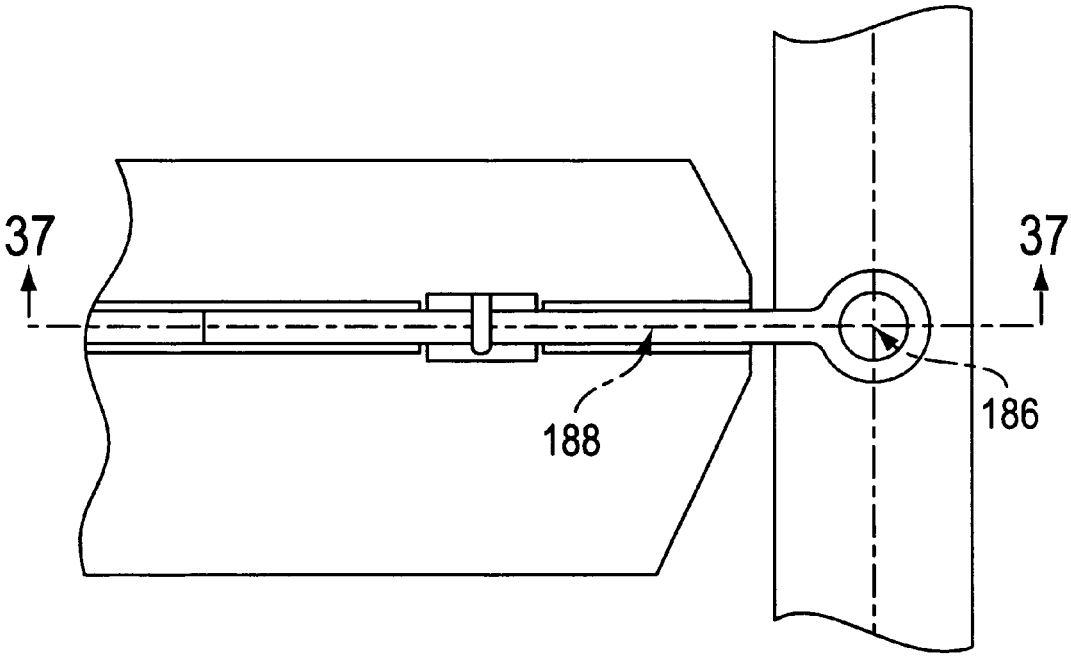
FIG. 36 is a "horizontal" section through a wing tip double pivot axis.

FIG. 36 shows the ama axis, 186, in the "vertical" plane for rotation in the "horizontal" plane and the wing pivot axis, 188, in the "horizontal" plane for trim in the "vertical" plane.

Figure 37:
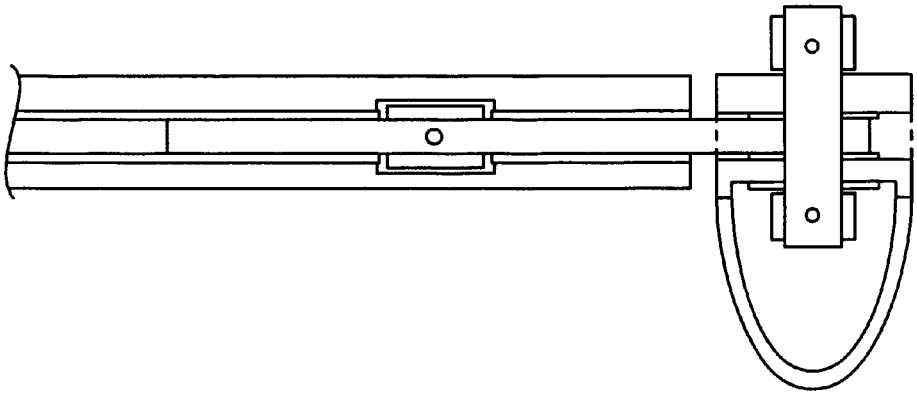
FIG. 37 is an aft looking cross-sectional view taken on a line 37—37 of FIG. 36.

FIG. 37 shows many of the same elements as FIGS. 35 and 36 in vertical cross section looking aft.

Figure 38:
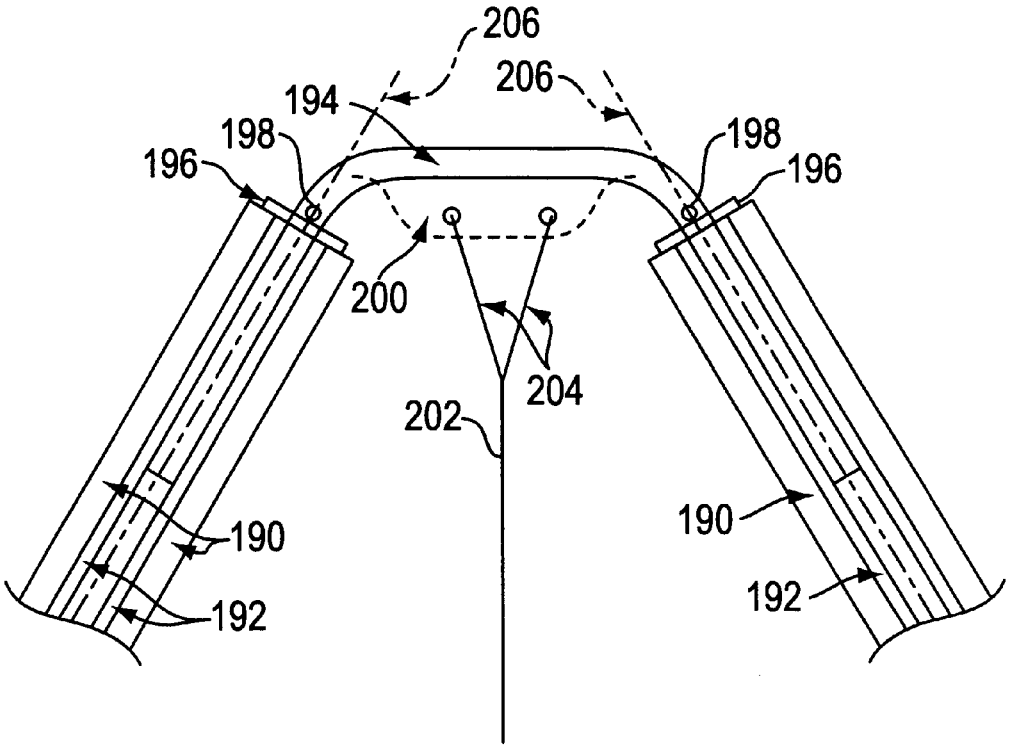
FIG. 38 is an aft looking cross-sectional view taken on a line 38—38 in FIG. 30 of a mast head pivot with tangs for fore and aft guy wires for a "triangle" rig.

The aft looking cross section in FIG. 38 shows the top portion of each of the canted symmetrical wings, 190, the spar tubes, 192, the mast head double pivot pin or bridge/axle, 194, washers or collars, 196, clevis pins, 198, the forward tang, 200, for the forward guy wire or forestay, 202, and harness, 204. The wingsails are trimmed about the pivot axes, 206, which continue through the pivot pins, shown in FIG. 39, at the base of the mast.

The masthead and mast base pivot pins position the wingsails transversely. They are held in place fore and aft by the forestay which is led to a padeye or chainplate on the bow deck of the fuselage or, in the case of a catamaran, a harness between the twin hulls.

Figure 39:
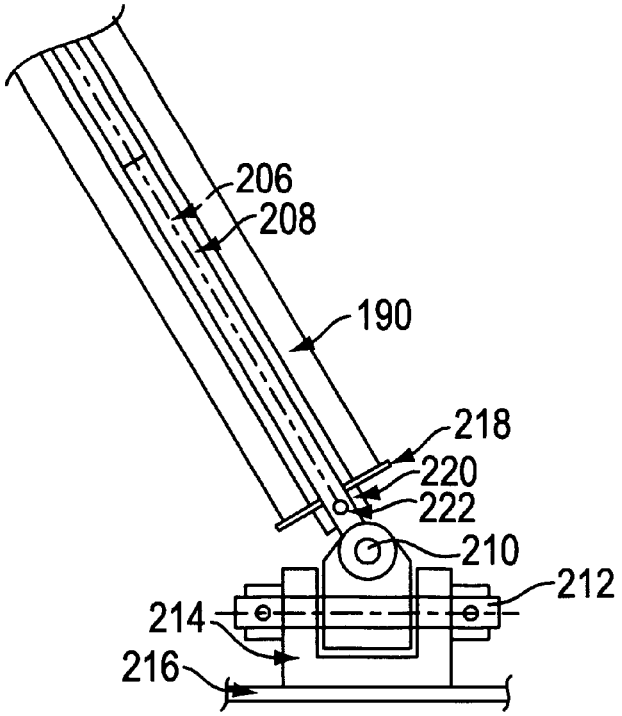
FIG. 39 is an aft looking cross-sectional view taken on a line 39—39 of FIG. 30 of a port side mast base double pivot axis for symmetrical, canted wingsails.

FIG. 39 shows the mast base pivot arrangement for port side of the opposing canted wingsails. The pivot pin, 208, is on the same axis, 206, as the upper port side of the pivot pin, 194, in FIG. 38. The pin, 210, through an eye at the base of 208 is for transverse adjustment of the mast cant when it is stepped. The perpendicular horizontal pin, 212, through the tabernacle, 214, mounted on the top of the hull or ama deck, 216, allows for lowering of the rig onto the deck of the craft where the width of the wingsail at its upper tip allows it to be trimmed flat in the athwartship plane.

The wingsail, 190, is positioned on the pivot pin, 208, by the washer, 218, collar, 220, and clevis pin, 222.

Figure 40:
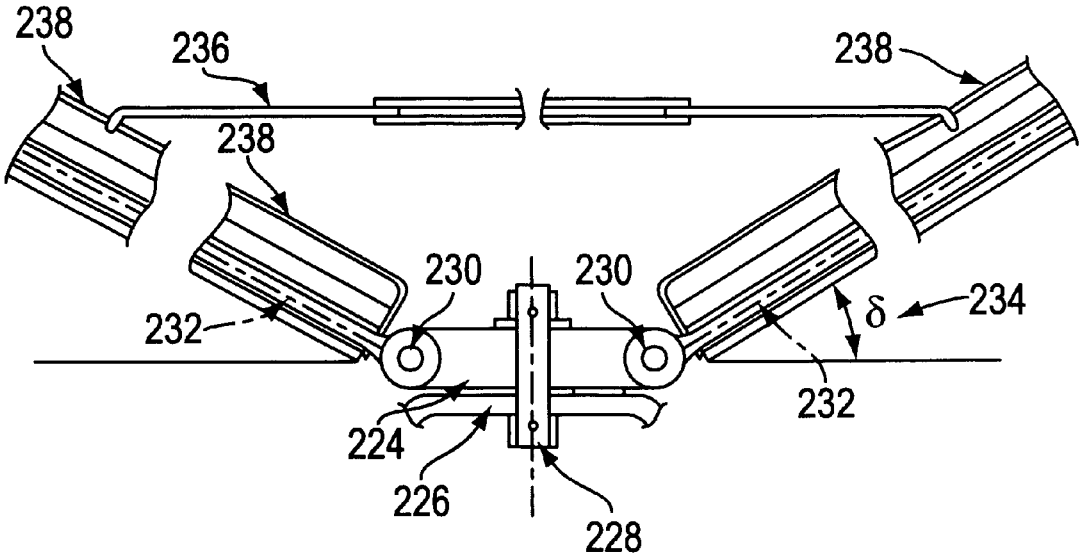
FIG. 40 is a hinged yoke providing for variation of the dihedral angle of the wings.

The hinged centerline wing-mounting yoke in FIG. 40 consists of a yoke platform, 224, mounted on the deck, 226, of the fuselage by means of the wing rotation pivot pin, 228, and a hinge pin, 230, through an eye at the base of the wing axis pivot pin, 232. The dihedral angle, δ, 234, is varied by moving a tie rod/compression strut, 236, along the slides, 238.

Figure 41:
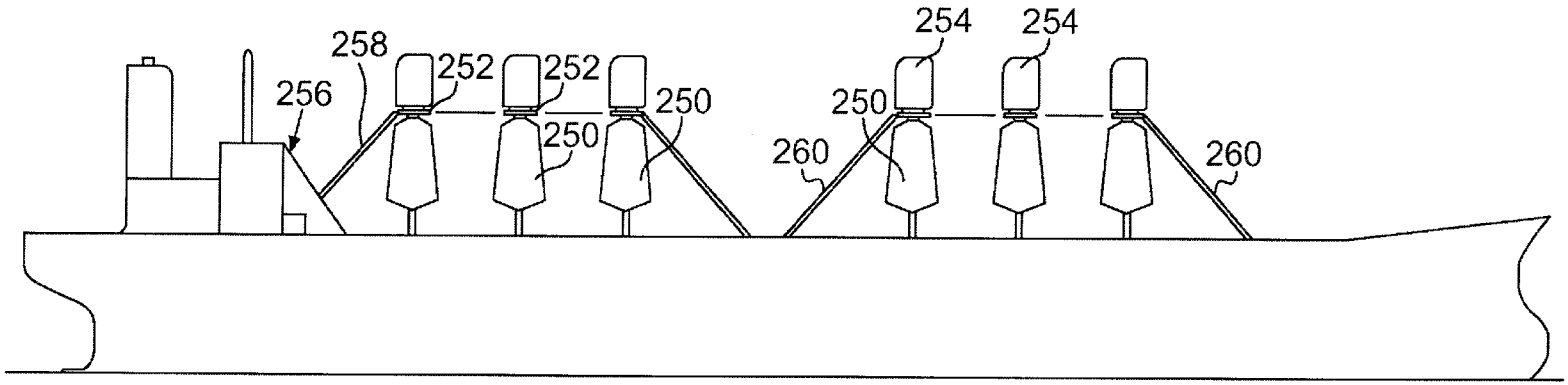
FIG. 41 is a side elevation view of an embodiment of a wind-powered air-water interface craft according to the present invention, which is a single hull ship with a tandem triangle rig.
Figure 42:
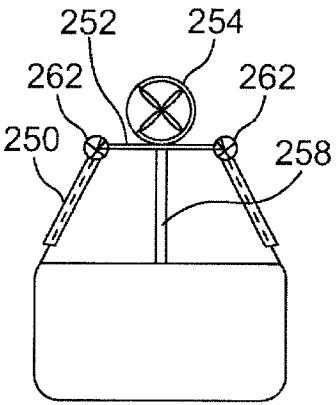
FIG. 42 is a bow or aft looking elevation of the craft shown in FIG. 41 showing wind turbines mounted on platforms at the tops of the rigs.
Figure 43:
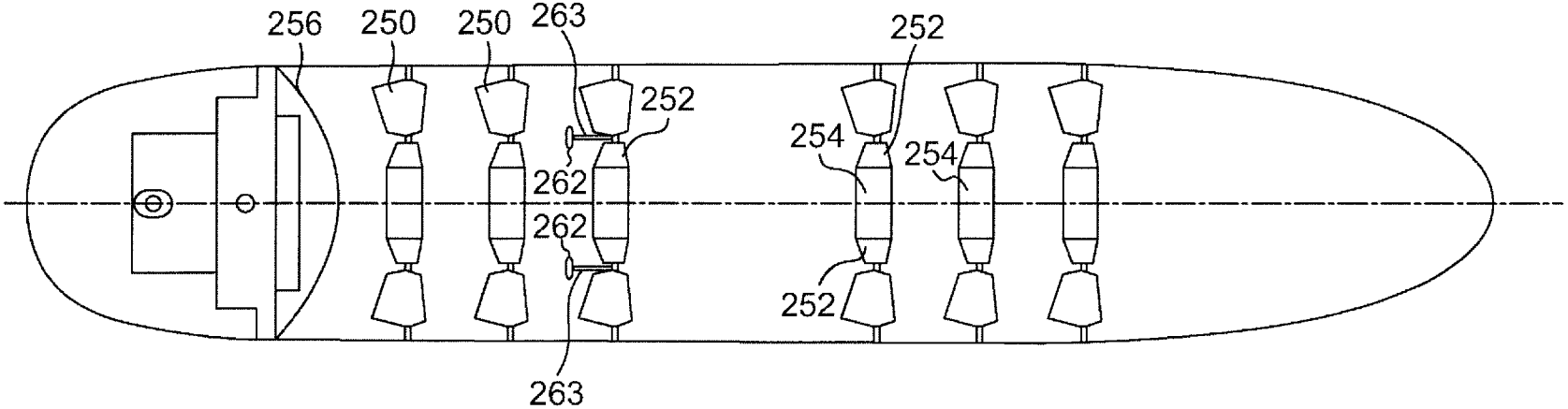
FIG. 43 is a top plan view of the craft shown in FIG. 41.
Figure 44:
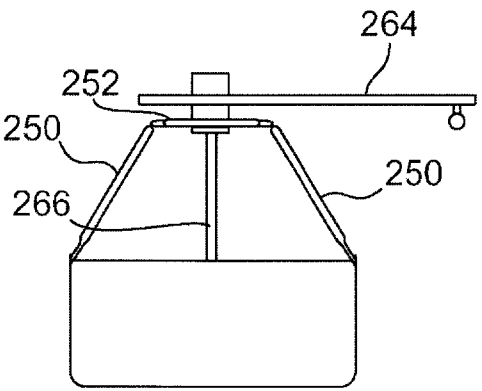
FIG. 44 is a bow elevation view of a single hull ship with a masthead platform used as a mount for a vertical axis horizontally swinging crane for loading and unloading cargo.

The basic elements of a single hull ship with tandem triangle rigs mounted to the rails or outside frames of the ship are shown in FIGS. 41 through 43. FIG. 44 shows details of some of these elements.

In FIG. 41, 42 and 43, the single hull ship shown is a heavy displacement cargo vessel whose draft (or depth below the waterline) varies depending on the weight of the cargo at any given time. The triangle rigs, described previously, have wing sails 250 and platforms 252 mounted on and integral with the masthead double pivot pin yoke. The drawing shows wind turbines 254 mounted on each of the platforms. Preferably, the turbines are mounted on supports (not shown) which allow them to swivel to face the wind. The swivel mounts may be of any conventional type such as an arcuate bearing or a rotatable shaft. The sails could be extended higher to a narrower platform for mounting a crane, or they could be extended to the full height of the superstructure and have nothing mounted above them as in the previously described versions of the triangle rig. The superstructure fairing 256 is a relatively aerodynamically shaped extension of the superstructure which might or might not have an additional structural or functional purpose. The streamlined section rig backstay 258 can be hollow to carry electric cables or hydraulic tubes. The other back, fore and horizontal stays 260 are also streamlined and can be hollow.

FIG. 42 shows a masthead platform mounted wind turbine 254. It also shows two secondary wing axis mounted turbines 262 that are trimmed with the wing sails so as to be in line with the wing tip vortices. FIG. 43 shows in plan view these same secondary turbines 262 mounted on extensions 263 extending from the platform 252 of one of the triangle rig elements.

In FIG. 44, a vertically pivoted, horizontally swinging crane, 264, for loading and unloading cargo is mounted on one of the masthead platforms 252. The crane may be of any type appropriate for the particular type of cargo to be transported by the vessel. A platform 252 which supports a crane may additionally require vertical support 266, which may preferably serve as a transmission shaft, transmitting power from the ships power plant to the crane 264.

Operation of the Craft

In the drawings, the craft of the first eight embodiments of the invention is shown sailing in dynamic equilibrium on starboard tack. The leeward side of the craft is shown as the port side and the windward side is shown as the starboard side. The craft is symmetrical about the fuselage or ship centerline, so that, under real sailing conditions, when the craft is maneuvered from starboard onto port tack, the windward side becomes port and the leeward side becomes starboard, all the port elements become windward and correspondingly starboard elements become leeward. However, for purposes of this description, leeward elements are interchangeable with port and windward elements with starboard.

The "datum waterplane" of the fuselage is the plane parallel to and at the waterline of the fuselage in an "upright" condition, when the angle between the horizontal and the underside of the port wing is equal to the angle between the horizontal and the underside of the starboard wing, i.e. equal to the dihedral angle of both wings. The datum waterplane is a reference plane for the geometry of the craft, not for the geometry of sailing equilibrium condition. The craft may fly, but not sail, in an "upright" condition. The "centerplane" of the fuselage or ship is the plane through the centerline of the fuselage and perpendicular to its waterplane.

The planes of the axes of the tailplanes, bowplanes and/or wings are parallel and rotate in a parallel disposition about axes defined by the line, hereinafter referred to as the pivot axis, which is the intersection of the plane of the wing or tail/bow plane axis and the centerplane of the fuselage. The planes or wings are trimmed about their spanwise axes to vary their angles of incidence to the relative wind. Effective incidence angle and/or effective camber of the wings may be further or more finely adjusted by trimming of flaps or ailerons on the trailing or leading edges of the wings.

Rotation of the wings refers to rotation about the pivot axes. Trim of the wings refers to rotation of wings about spanwise axes or movement of hinged flaps or ailerons.

The rotation of the wings and tail/bow planes serves two purposes, one, to align the leading edges of the wings so that they have maximum frontal length perpendicular to the relative wind direction and, two, to optimize the relationship of the center of effort and the center of lateral resistance of the craft and horizontal force balance of the craft. Balance and turning of the craft should be achieved by rotation through very small angles, even if there is only a single wing (i.e. no tail), and, if there is a tail/bow plane or tandem wing, turning and balance should be manageable just by varying the relative trim of the two wings.

Particularly in the high dihedral configuration, the forces affecting yaw of the craft are principally those on the windward wing elements or sails. Increasing the trim or incidence angle of the after sail/wing element or rotating the entire sail/wing system aft will increase the aerodynamic pressure aft and create a turning couple that will make the craft head closer to the wind and reduce the relative wind angle. Conversely, increasing the trim of the forward sail/wing element or rotating the sail/wing system forward will increase the aerodynamic pressure forward and create a turning couple that will make craft bear away from the wind and increase the relative wind angle.

The craft tacks by heading into the wind until, as it turns through the eye of the wind, the leeward surface of the windward sail/wing element becomes a windward surface causing it to roll to leeward and making the previously leeward wing element the new windward sail/wing element. Conversely, the craft jibes by bearing away from the wind until, as it turns through dead down wind, the leeward surface of the windward sail/wing element becomes a windward surface causing it to roll to leeward and making the previously leeward wing element the new windward sail/wing element.

While the windward wing elements provide sail driving force, the leeward wing elements provide vertical aerodynamic lift. The leeward vertical lift serves two purposes. One, it lifts the craft partially out of the water, reducing hydrodynamic drag. Two, it can be trimmed to provide a stabilizing moment to oppose the overturning roll moment developed by the sail/wing elements. If, as the craft begins to be overpowered by the wind, the sail/wing elements are feathered and the leeward wing elements are trimmed so as to shift the roll axis from the leeward ama to the central fuselage, the craft can lift off the water and fly/glide free in the air until it loses forward momentum.

The operation of the craft of the ninth, tenth, eleventh and twelfth embodiments, and similarly with the single hull ship version of the invention is similar to that of the first eight in that it has transverse symmetry about the centerline with regard to maneuvering through the eye of the wind. However, the craft has both wing/crossarms approximately horizontal and two opposing (sets of) wingsails disposed in a dynamically stable transverse configuration (See section on Forces and Moments.) providing driving forces independently of the wing/crossarms. Therefore, it is tacked or jibed more similarly to how a normal sailing craft is tacked or jibed, with both wingsail elements continuing to provide driving force on the opposite tack or jibe, only with no significant change of roll angle at all throughout the maneuver.

Forces and Moments in Dynamic Equilibrium

Figure 3:
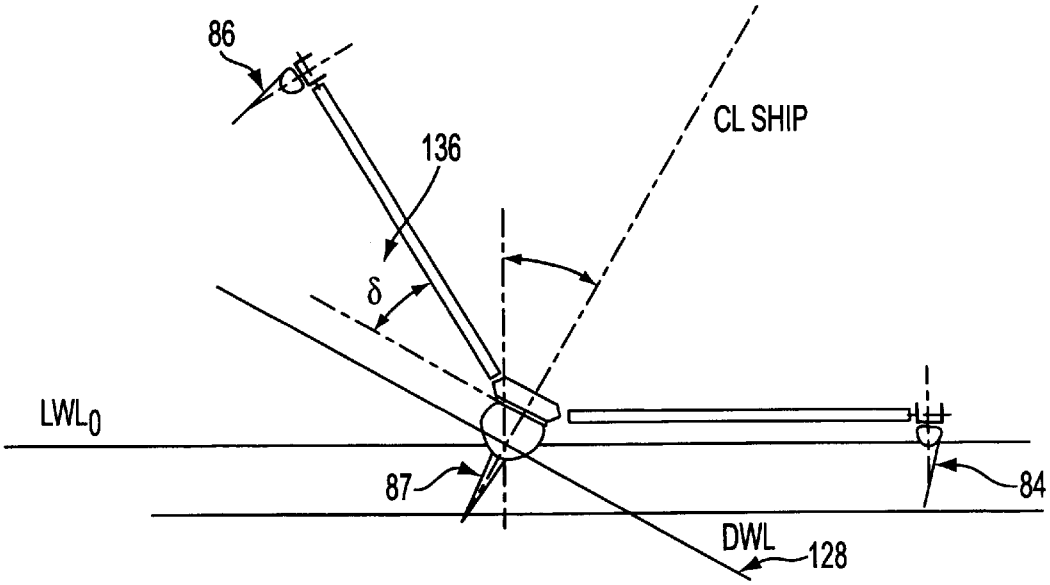
FIG. 3 is a front (i.e., bow) elevation thereof.
Figure 4:
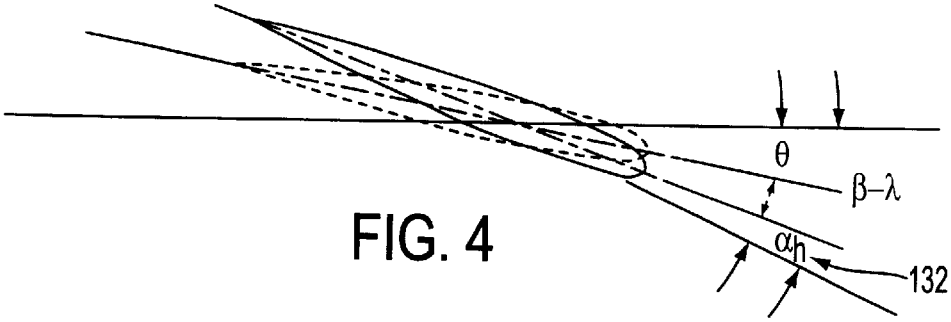
FIG. 4 is a transverse cross-sectional view of the starboard sail wing taken on line 4—4 of FIG. 2.
Figure 5:
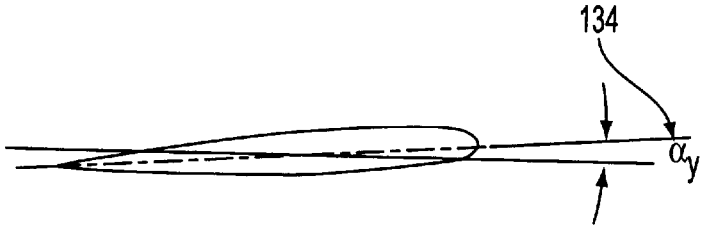
FIG. 5 is a transverse cross-sectional view of the port lifting wing taken on a line 5—5 of FIG. 1.

The relationship of angles and velocity vectors governing the drive and resistance forces on the craft i.e. equilibrium in the direction of motion in the horizontal plane are shown in FIG. 1. Element 124, $\lambda$, is the leeway angle of the craft. 126, $\theta$, is the angle of rotation of the wing about an axis perpendicular to the datum waterplane, 128, of the center hull. 130, B or $\beta$ is the angle between the relative wind direction and the course of the craft. In FIG. 4, 132, $\alpha_h$ is the trim angle of wing in a horizontal plane. In FIG. 5, 134, $\alpha_v$, is the trim angle of wing in a vertical plane. In FIG. 3, 136, d or $\delta$, is the dihedral angle of the wing or angle between the wing and the datum waterline plane. In FIG. 6, 8, 9 10 and 13, 138, P or $\phi$, is the heel angle or angle between the leeward wing spanwise axis and the LWL or load waterline plane, 240.

Figure 6:
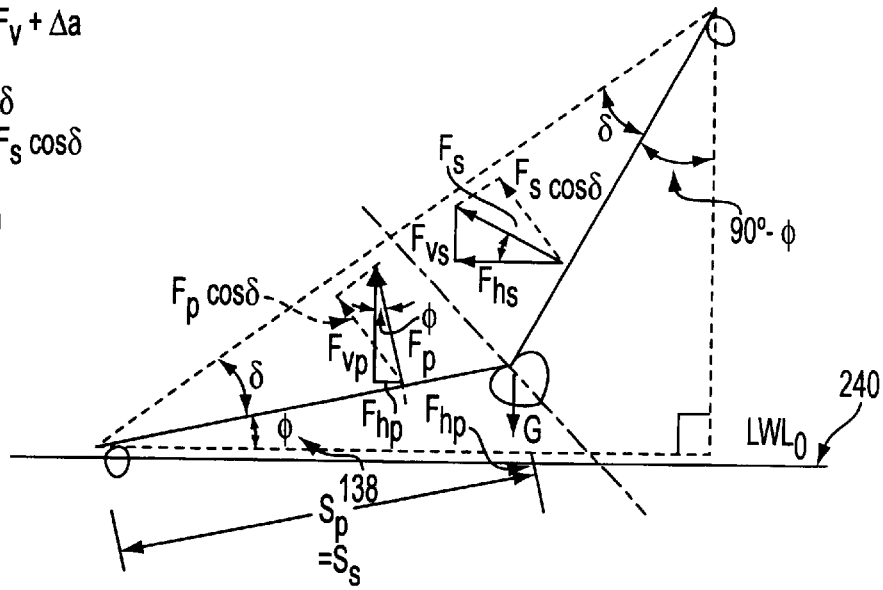
FIG. 6 is a schematic rear (i.e., aft) elevational view of the craft of FIGS. 1–5, showing a diagram for geometry of transverse rotation about the port ama.
Figure 7:
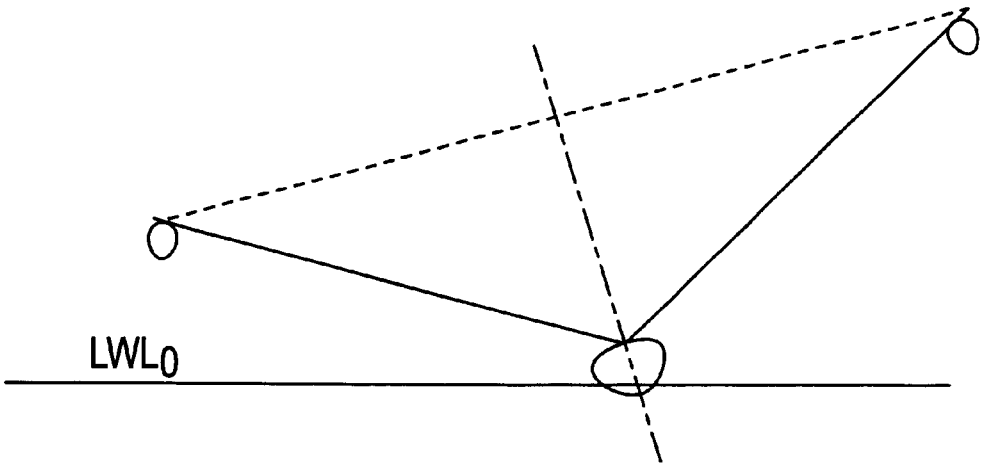
FIG. 7 is a schematic elevational view thereof showing a diagram for geometry of transverse rotation about the center hull.
Figure 8:
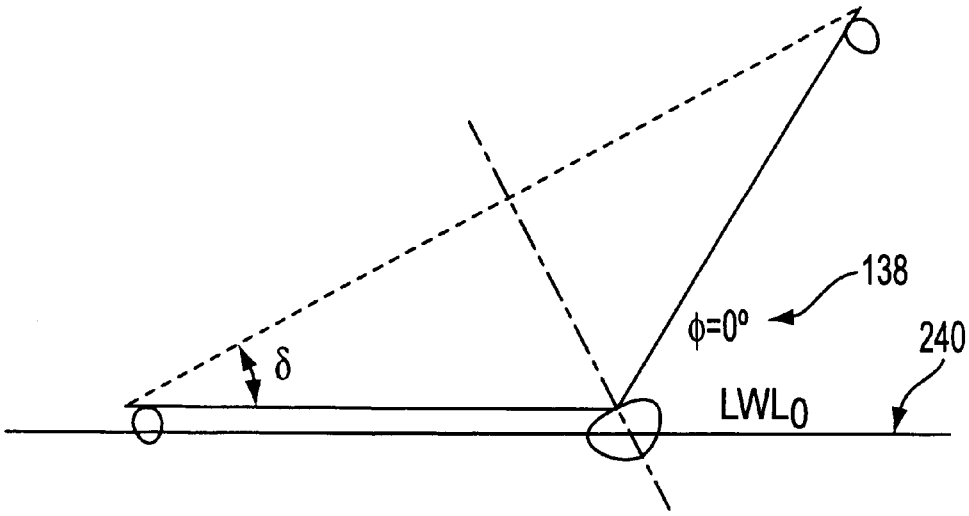
FIG. 8 is a schematic aft elevational view thereof showing a diagram in which the angle $\phi$ is 0°.
Figure 9:
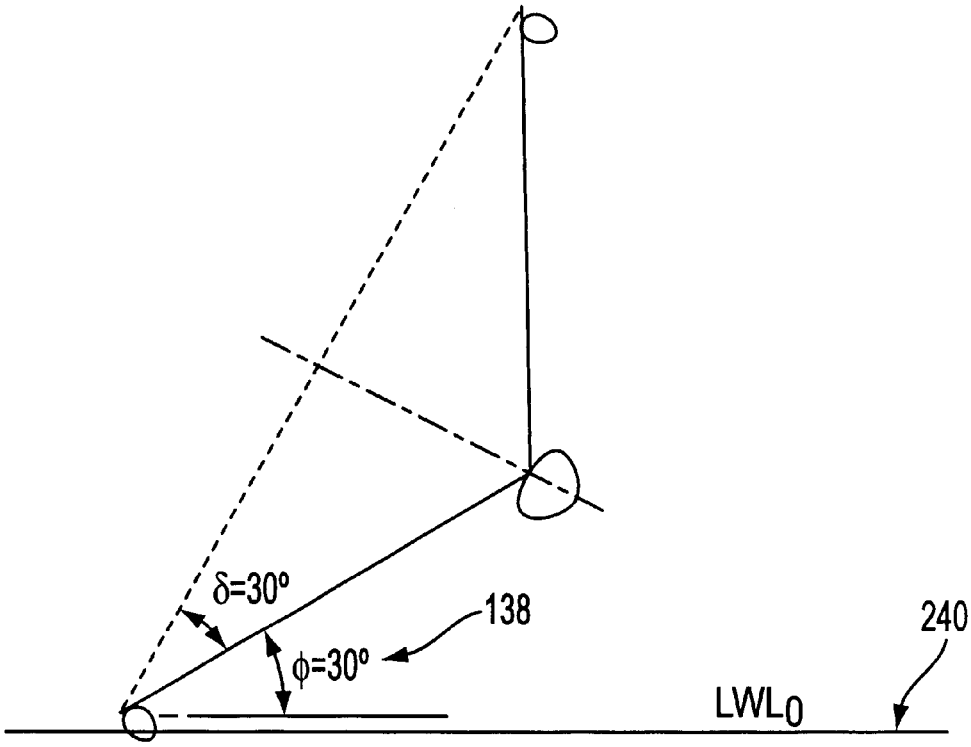
FIG. 9 is a schematic aft elevational view thereof showing a diagram in which the angle $\delta$ is 30° and the angle $\phi$ is 30°.
Figure 10:
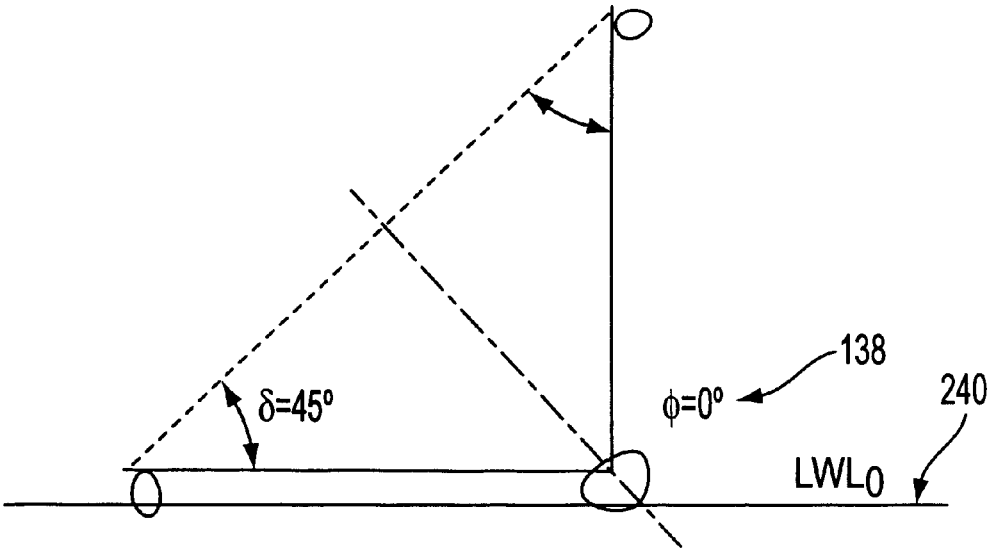
FIG. 10 is a schematic aft elevational view thereof showing a diagram in which the angle $\delta$ is 45° and the angle $\phi$ is 0°.

Trim of the leeward wing and tail/bow/tandem wing elements controls vertical lift on the craft. Trim of both windward and leeward wing elements control the roll or transverse stability of the craft. A schematic diagram of the basic configuration and the geometry and equations of forces and moments for transverse equilibrium is shown in FIG. 6. Some alternative configurations and/or geometries are shown in FIGS. 9 through 13.

FIG. 25 shows the balance of forces in transverse equilibrium for the ninth embodiment of the craft of the invention with the "triangle" rig. As can be seen in the diagram, the capsizing roll moment developed by the side force on the port and starboard wingsails is opposed by a righting moment developed by the vertical forces, downward on the port and upward on the starboard wingsail, each acting about an arm, 242, of length d. Thus, the craft in this embodiment is dynamically stable transversely.

It should now be apparent that the wind-powered air/water interface craft having various wing angles and configurations, as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A wind-powered air-water interface craft, comprising:

a single hull ship having a deck;

at least one pair of correspondingly canted wing sails having a respective port sail and a starboard sail thereof, the sails being mounted on a mounting structure constructed and arranged to provide variation in trim of the sails;

support structure associated with each pair of wing sails, the support structure constructed and arranged to supportively interconnect the respective port and starboard sails of each pair at at least one level on each sail, above the deck and to pivotally support each of the respective port and starboard sails of each pair along longitudinal axes thereof.

2. A wind-powered air-water interface craft according to claim 1, wherein a wind turbine generator is disposed at an upper end of at least one pair of wing sails.

3. A wind-powered air-water interface craft according to claim 1, wherein a crane is mounted at an upper end of at least one pair of wing sails.

4. A wind-powered air-water interface craft according to claim 1, wherein a platform is disposed at the top of at least one pair of wing sails.

5. A wind-powered air-water interface craft according to claim 1, wherein a wind turbine generator is disposed on the platform.

6. A wind-powered air-water interface craft according to claim 4, wherein a crane is mounted on the platform.

7. A wind-powered air-water interface craft, comprising:

a single hulled ship having a deck;

at least one pair of correspondingly canted wing sails having respective port and starboard sails thereof respectively, the sails being mounted on a mounting structure constructed and arranged to provide variation in trim of the sails;

support structure associated with each pair of wing sails, the support structure constructed and arranged to supportively interconnect the respective port and starboard sails of each pair at at least one level on each sail, above the deck and to pivotally support each of the respective port and starboard sails of each pair along longitudinal axes thereof;

the wing sails of each pair tapering in leading edge to trailing edge horizontal dimension with increasing distance above the deck.

8. A wind-powered air-water interface craft, comprising:

a single hull ship having a deck;

at least one pair of correspondingly canted wing sails having a respective port sail and a starboard sail thereof, the sails being mounted on a mounting structure constructed and arranged to provide variation in trim of the sails;

support structure associated with each pair of wing sails, the support structure constructed and arranged to supportively interconnect the respective port and starboard sails of each pair at at least one level on each sail, above the deck;

wherein a wind turbine generator is disposed at an upper end of at least one pair of wing sails.

9. A wind-powered air-water interface craft, comprising:

a single hull ship having a deck;

at least one pair of correspondingly canted wing sails having a respective port sail and a starboard sail thereof, the sails being mounted on a mounting structure constructed and arranged to provide variation in trim of the sails;

support structure associated with each pair of wing sails, the support structure constructed and arranged to supportively interconnect the respective port and starboard sails of each pair at at least one level on each sail, above the deck;

wherein a crane is mounted at an upper end of at least one pair of wing sails.

10. A wind-powered air-water interface craft, comprising:

a single hull ship having a deck;

at least one pair of correspondingly canted wing sails having a respective port sail and a starboard sail thereof, the sails being mounted on a mounting structure constructed and arranged to provide variation in trim of the sails;

support structure associated with each pair of wing sails, the support structure constructed and arranged to supportively interconnect the respective port and starboard sails of each pair at at least one level on each sail, above the deck;

wherein a platform is disposed at the top of at least one pair of wing sails.

11. A wind-powered air-water interface craft according to claim 10, wherein a wind turbine generator is disposed on the platform.

12. A wind-powered air-water interface craft according to claim 10, wherein a crane is mounted on the platform.

* * * * *